US012473124B2

(12) United States Patent
Eickhoff et al.

(10) Patent No.: US 12,473,124 B2
(45) Date of Patent: Nov. 18, 2025

(54) DRINK CUP LID

(71) Applicant: Berry Global, Inc., Evansville, IN (US)

(72) Inventors: Jonathan Eickhoff, Evansville, IN (US); Braxton J. Bragg, Evansville, IN (US); Jeffrey A. Mann, Evansville, IN (US)

(73) Assignee: Berry Global, Inc., Evansville, IN (US)

( * ) Notice: Subject to any disclaimer, the term of this patent is extended or adjusted under 35 U.S.C. 154(b) by 0 days.

(21) Appl. No.: 18/101,385

(22) Filed: Jan. 25, 2023

(65) Prior Publication Data

US 2023/0159232 A1 May 25, 2023

Related U.S. Application Data

(63) Continuation of application No. 16/993,493, filed on Aug. 14, 2020, now Pat. No. 11,591,140.

(60) Provisional application No. 62/887,252, filed on Aug. 15, 2019.

(51) Int. Cl.

| | |
|---|---|
| ***B65D 43/02*** | (2006.01) |
| ***A47G 19/22*** | (2006.01) |
| ***B65D 47/08*** | (2006.01) |

(52) U.S. Cl.

CPC ..... *B65D 43/0212* (2013.01); *A47G 19/2272* (2013.01); *B65D 47/0833* (2013.01); *B65D 2543/00046* (2013.01); *B65D 2543/00092* (2013.01); *B65D 2543/00712* (2013.01)

(58) Field of Classification Search

CPC ..... A47G 19/2272; B65D 2543/00046; B65D 2543/00092; B65D 2543/00296; B65D 2543/00537; B65D 2543/00712; B65D 2543/00731; B65D 2543/00796; B65D 43/02; B65D 43/0212; B65D 47/0833

USPC ..... 220/711, 713, 780, 229, 784; 229/404

See application file for complete search history.

(56) References Cited

U.S. PATENT DOCUMENTS

| | | | |
|---|---|---|---|
| D7,248 | S | 3/1874 | Elstrand |
| D53,911 | S | 10/1919 | Humphrey |
| D58,571 | S | 8/1921 | Hyatt |
| 1,395,594 | A | 11/1921 | Pfefferle |
| D62,268 | S | 4/1923 | Stern |
| D64,091 | S | 2/1924 | Weintraub |
| D65,193 | S | 7/1924 | Leveridge |
| 1,624,849 | A | 4/1927 | Steele |
| D78,805 | S | 6/1929 | Burke |
| 1,755,042 | A | 4/1930 | Zoller |
| 1,773,972 | A | 8/1930 | Eberhart |

(Continued)

FOREIGN PATENT DOCUMENTS

| | | |
|---|---|---|
| CA | 3059250 A1 | 10/2018 |
| CN | 3107990 | 1/1999 |

(Continued)

OTHER PUBLICATIONS

Office Action (Final Rejection) dated May 20, 2024 for U.S. Appl. No. 18/127,353, (pp. 1-19).

(Continued)

*Primary Examiner* — Nathan J Jenness
*Assistant Examiner* — Madison L Poos
(74) *Attorney, Agent, or Firm* — Barnes & Thornburg LLP

(57) ABSTRACT

A liquid container includes a cup having a brim forming an opening into an interior region of the cup. The container also includes a lid configured to mount on the brim of the cup to close the opening.

14 Claims, 29 Drawing Sheets

(56) References Cited

U.S. PATENT DOCUMENTS 1,940,088 A 12/1933 Harrison
2,015,028 A 9/1935 Gillette
2,050,487 A 8/1936 Durrant
2,120,403 A 6/1938 Godfrey
D111,097 S 8/1938 White
2,174,618 A 10/1939 Burdick
2,271,589 A 2/1942 Hendrickson
2,313,801 A 3/1943 Carll
2,374,092 A 4/1945 Glaser
D141,225 S 5/1945 Ray
2,447,407 A 8/1948 Grain
2,649,984 A 8/1953 Abt
D172,089 S 5/1954 Pree
2,766,796 A 10/1956 Tupper
2,985,354 A 5/1961 Aldington
3,027,596 A 4/1962 Knowles
3,048,317 A 8/1962 Cochrane
3,055,540 A 9/1962 Ringlen
3,065,875 A 11/1962 Negoro
3,071,281 A 1/1963 Sawai
3,103,224 A 9/1963 Dearling
3,128,903 A 4/1964 Crisci
3,245,691 A 4/1966 Gorman
3,262,602 A 7/1966 McConnell
3,269,734 A 8/1966 Ottofy
3,301,459 A 1/1967 Gardner
3,329,304 A 7/1967 Crisci
3,329,305 A 7/1967 Crisci
3,349,950 A 10/1967 Wanderer
3,392,468 A 7/1968 Wolf
3,421,653 A 1/1969 Whaley
3,433,378 A 3/1969 Ross
3,502,765 A 3/1970 Spencer
3,524,566 A 8/1970 Parks
3,561,668 A 2/1971 Bergstrom
3,583,596 A 6/1971 Brewer
D221,420 S 8/1971 Davis
3,604,588 A 9/1971 Winnick
3,609,263 A 9/1971 Clementi
3,610,306 A 10/1971 Summers
3,612,342 A 10/1971 Rathbun
3,624,787 A 11/1971 Newman
D222,905 S 2/1972 Kinney
3,676,089 A 7/1972 Swett
3,677,435 A 7/1972 Davis
3,679,088 A 7/1972 Swett
3,679,089 A 7/1972 Swett
D226,063 S 1/1973 Warnberg
3,734,276 A 5/1973 Bank
3,743,133 A 7/1973 Rathbun
3,745,055 A 7/1973 Gorman
3,746,158 A 7/1973 Connick
3,752,042 A 8/1973 Castille
3,768,688 A 10/1973 Linke
3,789,095 A 1/1974 Winstead
3,805,991 A 4/1974 Cheladze
3,817,420 A 6/1974 Heisler
3,828,637 A 8/1974 Slack
3,840,144 A 10/1974 Dry
D233,599 S 11/1974 Davis
3,926,084 A 12/1975 Blazer
RE28,797 E 5/1976 Brewer
3,954,923 A 5/1976 Valyi
3,964,635 A * 6/1976 Ludder ..... B65D 43/0212 220/784
3,974,916 A 8/1976 Bartolucci
3,977,563 A 8/1976 Holt
3,994,411 A 11/1976 Elfelt
D242,736 S 12/1976 Craft, III
D242,738 S 12/1976 Michaeli
4,006,839 A 2/1977 Thiel
4,007,936 A 2/1977 Hornsby
4,018,355 A 4/1977 Ando
4,026,459 A 5/1977 Blanchard
4,054,229 A 10/1977 Arfert
4,061,706 A 12/1977 Duffield
D246,955 S 1/1978 Davis
4,074,827 A 2/1978 Labe
4,078,686 A 3/1978 Karesh
D248,376 S 7/1978 Allen
D251,828 S 5/1979 Smith
4,190,174 A 2/1980 Haimowitz
4,194,645 A 3/1980 Zabner
4,210,258 A 7/1980 Von Holdt
4,211,743 A 7/1980 Nauta et al.
D256,558 S 8/1980 Smith
D258,576 S 3/1981 Smith
4,266,689 A 5/1981 Asher
D261,486 S 10/1981 Smith
4,293,080 A 10/1981 Letica
D262,691 S 1/1982 Horsley
D264,440 S 5/1982 Austin
D264,690 S 6/1982 Bagwell
4,349,119 A 9/1982 Letica
4,351,448 A 9/1982 Ingersoll
4,370,908 A 2/1983 Dealto
4,380,305 A 4/1983 Von Holdt
4,389,802 A 6/1983 McLaren
4,408,698 A 10/1983 Ballester
4,412,467 A 11/1983 Desanto
4,413,964 A 11/1983 Winstead
D271,857 S 12/1983 Callahan
4,421,244 A 12/1983 Van Melle
4,421,712 A 12/1983 Winstead
D272,324 S 1/1984 Mumford
4,444,332 A 4/1984 Widen
4,446,986 A 5/1984 Bowen
4,474,305 A 10/1984 Marco
4,508,235 A 4/1985 Steele
4,518,097 A 5/1985 Milton
4,524,882 A 6/1985 Buc
4,562,937 A 1/1986 Iyengar
D286,026 S 10/1986 Rayner
4,629,088 A 12/1986 Durgin
4,640,434 A 2/1987 Johnsen
4,640,435 A 2/1987 Dutt
4,674,644 A 6/1987 Jacobs
4,679,699 A 7/1987 Malsbury
D292,380 S 10/1987 Smith
4,721,210 A 1/1988 Lawrence
4,722,820 A 2/1988 Flecknoe-Brown
4,782,976 A 11/1988 Kenyon
D298,919 S 12/1988 Gee
4,799,602 A 1/1989 Collins
4,836,407 A 6/1989 Bruce
4,872,586 A 10/1989 Landis
4,886,184 A 12/1989 Chamourian
4,934,557 A 6/1990 Smith
D309,564 S 7/1990 Rayner
4,971,211 A 11/1990 Lake
4,994,229 A 2/1991 Flecknoe-Brown
D317,262 S 6/1991 Bluff
5,064,082 A 11/1991 Lombardi
5,088,367 A 2/1992 Cracchiolo
5,099,232 A 3/1992 Howes
5,106,567 A 4/1992 Demerest
5,111,961 A 5/1992 Van Melle
5,151,233 A 9/1992 Wendt
5,180,079 A 1/1993 Jeng
5,188,691 A 2/1993 Caputo
5,197,624 A * 3/1993 Dodaro ..... B65D 47/0833 220/269
5,219,627 A 6/1993 Arase
D339,027 S 9/1993 Mack
5,375,828 A 12/1994 Shikami
5,377,860 A 1/1995 Littlejohn
5,390,810 A 2/1995 Stroble
5,397,023 A 3/1995 Toczek
5,398,843 A 3/1995 Warden
5,427,266 A 6/1995 Yun
D360,133 S 7/1995 Boller
5,460,286 A 10/1995 Rush
D365,516 S 12/1995 Williamson
5,489,026 A 2/1996 Daloia

(56) References Cited

U.S. PATENT DOCUMENTS

| | | | |
|---|---|---|---|
| D368,430 | S | 4/1996 | Herzog |
| D368,444 | S | 4/1996 | Shryock |
| 5,503,289 | A | 4/1996 | Fox |
| 5,509,568 | A | 4/1996 | Warden |
| 5,524,788 | A | 6/1996 | Plester |
| 5,531,347 | A | 7/1996 | Goulding |
| 5,542,532 | A | 8/1996 | Mitchell |
| D374,822 | S | 10/1996 | Philips |
| 5,592,766 | A | 1/1997 | Mygatt |
| 5,613,619 | A | 3/1997 | Van Melle |
| 5,614,228 | A | 3/1997 | Demerest |
| 5,641,063 | A | 6/1997 | Gambardella |
| D380,385 | S | 7/1997 | Litke |
| D381,267 | S | 7/1997 | Rush |
| D384,580 | S | 10/1997 | Fernandes |
| D384,862 | S | 10/1997 | Hayes |
| 5,713,463 | A | 2/1998 | Lakoski |
| 5,722,558 | A | 3/1998 | Thompson |
| 5,746,312 | A | 5/1998 | Johnson |
| 5,769,263 | A | 6/1998 | Willingham |
| 5,775,194 | A | 7/1998 | Spada |
| 5,783,229 | A | 7/1998 | Manlove |
| 5,791,509 | A | 8/1998 | Rush |
| 5,795,535 | A | 8/1998 | Giovannone |
| D398,997 | S | 9/1998 | Taylor |
| 5,806,707 | A | 9/1998 | Boehm |
| 5,820,016 | A | 10/1998 | Stropkay |
| 5,829,583 | A | 11/1998 | Verweyst |
| 5,839,601 | A | 11/1998 | Melle |
| 5,868,309 | A | 2/1999 | Sandstrom |
| D408,223 | S | 4/1999 | Henry |
| 5,894,952 | A | 4/1999 | Mendenhall |
| 5,913,964 | A | 6/1999 | Melton |
| 5,947,278 | A | 9/1999 | Sawhney |
| 5,947,323 | A | 9/1999 | Freek |
| 5,979,690 | A | 11/1999 | Hartley |
| 5,983,693 | A | 11/1999 | Bodnar |
| 6,021,917 | A | 2/2000 | Lovell |
| 6,056,144 | A | 5/2000 | Strange |
| 6,070,752 | A | 6/2000 | Nava |
| D428,355 | S | 7/2000 | Kavalek |
| 6,086,800 | A | 7/2000 | Manlove |
| 6,089,397 | A | 7/2000 | Van Melle |
| D432,868 | S | 10/2000 | Tan |
| 6,126,035 | A | 10/2000 | Schaper |
| 6,161,354 | A | 12/2000 | Gilbert |
| D437,223 | S | 2/2001 | Coy |
| D437,671 | S | 2/2001 | Fajerstein |
| 6,196,404 | B1 | 3/2001 | Chen |
| 6,196,411 | B1 | 3/2001 | Nava |
| 6,216,857 | B1 | 4/2001 | Gordon |
| 6,257,435 | B1 | 7/2001 | Chedister |
| 6,257,629 | B1 | 7/2001 | Weichelt |
| D446,150 | S | 8/2001 | Bamminger |
| 6,279,300 | B1 | 8/2001 | Simhaee |
| 6,299,014 | B1 | 10/2001 | Nava |
| 6,302,288 | B1 | 10/2001 | Nava |
| 6,311,860 | B1 | 11/2001 | Reidinger |
| 6,319,456 | B1 | 11/2001 | Gilbert |
| D452,155 | S | 12/2001 | Stodd |
| 6,330,943 | B1 | 12/2001 | Gordon |
| 6,349,821 | B1 | 2/2002 | Gordon |
| 6,357,619 | B1 | 3/2002 | Schaefer |
| 6,364,102 | B1 | 4/2002 | Gordon |
| 6,371,289 | B1 | 4/2002 | Gordon |
| 6,394,783 | B1 | 5/2002 | Dalgewicz, III |
| 6,404,730 | B2 | 6/2002 | Yeo |
| 6,412,629 | B1 | 7/2002 | Gordon |
| 6,419,112 | B1 | 7/2002 | Bruce |
| D461,141 | S | 8/2002 | Steiner |
| 6,427,832 | B1 | 8/2002 | Ali |
| 6,454,087 | B2 | 9/2002 | Gordon |
| 6,460,716 | B1 | 10/2002 | Wong |
| 6,464,072 | B2 | 10/2002 | Gordon |
| 6,478,148 | B2 | 11/2002 | Gordon |
| 6,481,573 | B2 | 11/2002 | Gordon |
| D468,494 | S | 1/2003 | Holloway |
| D469,693 | S | 2/2003 | Weiss |
| D471,810 | S | 3/2003 | Hayes |
| 6,533,114 | B1 | 3/2003 | Gordon |
| 6,554,154 | B1 | 4/2003 | Chauhan |
| 6,557,698 | B2 | 5/2003 | Gordon |
| 6,561,122 | B1 | 5/2003 | Kurja |
| 6,561,345 | B2 | 5/2003 | Gordon |
| 6,571,943 | B2 | 6/2003 | Gordon |
| 6,576,309 | B2 | 6/2003 | Dalgewicz, III |
| 6,588,182 | B2 | 7/2003 | Gordon |
| 6,598,741 | B2 | 7/2003 | Gordon |
| 6,604,629 | B2 | 8/2003 | Gordon |
| 6,612,456 | B1 | 9/2003 | Hundley |
| 6,625,959 | B2 | 9/2003 | Gordon |
| 6,626,288 | B2 | 9/2003 | Gordon |
| D480,968 | S | 10/2003 | Atkins |
| 6,641,384 | B2 | 11/2003 | Bosler |
| 6,647,696 | B2 | 11/2003 | Gordon |
| 6,648,134 | B2 | 11/2003 | Gordon |
| D482,985 | S | 12/2003 | Bombeke |
| 6,688,487 | B2 | 2/2004 | Oakes |
| D487,411 | S | 3/2004 | Bamminger |
| 6,737,008 | B2 | 5/2004 | Gilbert |
| D492,901 | S | 7/2004 | Woods |
| 6,814,905 | B1 | 11/2004 | Dalgewicz |
| 6,840,375 | B2 | 1/2005 | Gordon |
| 6,846,533 | B2 | 1/2005 | Wu |
| D502,050 | S | 2/2005 | Munson |
| 6,874,649 | B2 | 4/2005 | Clarke |
| 6,886,707 | B2 | 5/2005 | Giraud |
| 6,889,860 | B2 | 5/2005 | Mazzarolo |
| 6,907,702 | B2 | 6/2005 | Gilbert |
| 6,910,599 | B2 | 6/2005 | Tucker |
| 6,923,338 | B2 | 8/2005 | Dees |
| 6,929,143 | B2 | 8/2005 | Mazzarolo |
| 6,932,234 | B2 | 8/2005 | Damato |
| 6,948,633 | B2 | 9/2005 | Freek |
| 6,959,829 | B2 | 11/2005 | Crider |
| 7,000,522 | B2 | 2/2006 | Pfaff, Jr. |
| D516,910 | S | 3/2006 | Bresler |
| D517,322 | S | 3/2006 | Zettle |
| 7,017,774 | B2 | 3/2006 | Haedt |
| D519,374 | S | 4/2006 | Hornke |
| D521,382 | S | 5/2006 | Gross |
| D522,240 | S | 6/2006 | Laval |
| 7,055,715 | B2 | 6/2006 | Maravich |
| 7,063,224 | B2 | 6/2006 | Clarke |
| D525,869 | S | 8/2006 | Tedford, Jr. |
| D527,261 | S | 8/2006 | Hrnke |
| 7,100,787 | B2 | 9/2006 | Farnsworth |
| 7,108,495 | B2 | 9/2006 | Gilbert |
| D529,391 | S | 10/2006 | Glass |
| D533,777 | S | 12/2006 | Hundley |
| 7,144,619 | B2 | 12/2006 | Ramchandra |
| 7,156,251 | B2 | 1/2007 | Smith |
| 7,157,034 | B2 | 1/2007 | Bristow |
| 7,159,732 | B2 | 1/2007 | Smith |
| 7,169,855 | B2 | 1/2007 | Yamaguchi |
| 7,175,042 | B2 | 2/2007 | Durdon |
| 7,213,709 | B2 | 5/2007 | Moskovich |
| D543,787 | S | 6/2007 | Wasserman |
| 7,225,945 | B2 | 6/2007 | Crider |
| 7,232,302 | B2 | 6/2007 | Marzona |
| 7,246,714 | B2 | 7/2007 | Garg |
| 7,255,391 | B2 | 8/2007 | Bristow |
| 7,284,673 | B2 | 10/2007 | Habeger |
| 7,284,676 | B2 | 10/2007 | Dantani |
| D556,037 | S | 11/2007 | D'Amato |
| D556,574 | S | 12/2007 | Hollis |
| D559,105 | S | 1/2008 | D'Amato |
| D560,120 | S | 1/2008 | Maravich |
| 7,318,536 | B2 | 1/2008 | Maravich |
| 7,318,563 | B2 | 1/2008 | Houts |
| 7,328,791 | B1 | 2/2008 | Bosworth |
| D564,354 | S | 3/2008 | Maravich |
| 7,353,582 | B2 | 4/2008 | MacKenzie |
| D569,245 | S | 5/2008 | Joshi |

(56) References Cited

U.S. PATENT DOCUMENTS

| | | | |
|---|---|---|---|
| D570,685 | S | 6/2008 | Koennecke |
| D570,686 | S | 6/2008 | Hollis |
| D572,587 | S | 7/2008 | Rush |
| D574,231 | S | 8/2008 | Laval |
| D574,238 | S | 8/2008 | Walker, III |
| D574,290 | S | 8/2008 | Shah |
| 7,413,698 | B2 | 8/2008 | Bearse |
| D578,829 | S | 10/2008 | Freeman |
| 7,455,006 | B2 | 11/2008 | Toth |
| 7,464,831 | B2 | 12/2008 | Aiken |
| 7,484,639 | B2 | 2/2009 | Maravich |
| D588,002 | S | 3/2009 | D'Amato |
| 7,513,382 | B2 | 4/2009 | Clarke |
| 7,523,534 | B2 | 4/2009 | MacKenzie |
| D591,476 | S | 5/2009 | Colman |
| D592,952 | S | 5/2009 | Hundley |
| D593,892 | S | 6/2009 | Schneider |
| 7,549,559 | B2 | 6/2009 | Conroy |
| D596,524 | S | 7/2009 | Schneider |
| 7,591,389 | B2 | 9/2009 | Wong |
| 7,611,660 | B2 | 11/2009 | Bosler |
| 7,624,536 | B2 | 12/2009 | Schromm |
| 7,628,946 | B2 | 12/2009 | Gandon |
| 7,642,316 | B2 | 1/2010 | Rego |
| 7,658,296 | B2 | 2/2010 | Van Handel |
| 7,658,882 | B2 | 2/2010 | Minganti |
| 7,676,909 | B2 | 3/2010 | MacKenzie |
| 7,685,677 | B2 | 3/2010 | Garg |
| D613,199 | S | 4/2010 | Schneider |
| 7,691,302 | B2 | 4/2010 | Hollis |
| D614,954 | S | 5/2010 | Crowell |
| 7,754,299 | B2 | 7/2010 | Wu |
| 7,762,213 | B2 | 7/2010 | Cook |
| 7,784,641 | B2 | 8/2010 | Chou |
| D624,413 | S | 9/2010 | Selina |
| 7,819,271 | B2 | 10/2010 | Hollis |
| 7,837,923 | B2 | 11/2010 | Bearse |
| 7,845,510 | B2 | 12/2010 | Schmidtner |
| 7,845,514 | B2 | 12/2010 | Rush |
| 7,850,812 | B2 | 12/2010 | Sekar |
| 7,866,502 | B2 | 1/2011 | Maxwell |
| 7,874,449 | B1 | 1/2011 | Studee |
| 7,992,741 | B2 | 8/2011 | Hundley |
| 7,997,230 | B2 | 8/2011 | Cook |
| 8,007,269 | B1 | 8/2011 | Otto |
| 8,038,432 | B2 | 10/2011 | Mazzarolo |
| 8,074,331 | B2 | 12/2011 | Voges |
| 8,074,831 | B2 | 12/2011 | Walker |
| 8,084,109 | B2 | 12/2011 | Gao |
| 8,113,379 | B2 | 2/2012 | Cai |
| 8,142,587 | B2 | 3/2012 | Sekar |
| 8,142,599 | B2 | 3/2012 | Sekar |
| 8,152,018 | B2 | 4/2012 | Smith |
| 8,196,500 | B2 | 6/2012 | Mansfield |
| 8,211,355 | B2 | 7/2012 | Otto |
| 8,276,776 | B2 | 10/2012 | Roth |
| 8,282,382 | B2 | 10/2012 | Mazzarolo |
| 8,286,823 | B2 | 10/2012 | Turvey |
| 8,287,270 | B2 | 10/2012 | Lee |
| 8,308,884 | B2 | 11/2012 | Sekar |
| 8,312,993 | B2 | 11/2012 | Sams |
| 8,317,050 | B2 | 11/2012 | Hollis |
| 8,348,053 | B2 | 1/2013 | Bellamah |
| 8,418,871 | B1 | 4/2013 | Lamasney |
| 8,430,268 | B2 | 4/2013 | Weiss |
| D685,286 | S | 7/2013 | Bhansali |
| 8,474,643 | B2 | 7/2013 | Hundley |
| 8,486,211 | B2 | 7/2013 | Sekar |
| 8,499,947 | B2 | 8/2013 | Trost |
| 8,544,677 | B2 | 10/2013 | Selina |
| D693,181 | S | 11/2013 | Chase |
| D694,109 | S | 11/2013 | Tanner |
| 8,573,400 | B1 | 11/2013 | Lamasney |
| 8,592,014 | B2 | 11/2013 | Alvarez |
| D695,612 | S | 12/2013 | Chou |
| 8,616,405 | B2 | 12/2013 | French |
| D696,940 | S | 1/2014 | Hale |
| 8,623,261 | B2 | 1/2014 | Patkar |
| 8,628,319 | B2 | 1/2014 | Mazzarolo |
| 8,628,718 | B2 | 1/2014 | Li |
| 8,632,831 | B2 | 1/2014 | Perry |
| D699,619 | S | 2/2014 | Kothari |
| 8,642,102 | B2 | 2/2014 | Field |
| D700,513 | S | 3/2014 | Carsrud |
| 8,662,880 | B2 | 3/2014 | Fowler |
| 8,753,106 | B2 | 6/2014 | Lee |
| 8,764,928 | B2 | 7/2014 | Sekar |
| 8,771,451 | B2 | 7/2014 | Sekar |
| 8,777,013 | B1 | 7/2014 | Jalindre |
| 8,777,046 | B2 | 7/2014 | Mann |
| 8,800,801 | B2 | 8/2014 | Freeman |
| 8,895,092 | B1 | 11/2014 | Field |
| 8,939,312 | B1 | 1/2015 | Buck |
| D722,873 | S | 2/2015 | Wu |
| 8,950,623 | B2 | 2/2015 | Fleming |
| D726,025 | S | 4/2015 | Somers |
| 9,034,231 | B2 | 5/2015 | Tabor |
| D732,959 | S | 6/2015 | Branstad |
| 9,051,106 | B2 | 6/2015 | Milano |
| D734,894 | S | 7/2015 | Schlatter |
| 9,078,535 | B1 | 7/2015 | Buck |
| 9,102,446 | B2 | 8/2015 | Kowal |
| 9,114,902 | B2 | 8/2015 | Temple, Jr. |
| D737,689 | S | 9/2015 | Monteparo |
| 9,144,464 | B2 | 9/2015 | Knowlton |
| 9,156,950 | B2 | 10/2015 | Garralda |
| D744,288 | S | 12/2015 | Rosen |
| 9,199,776 | B1 | 12/2015 | Bruce |
| D746,682 | S | 1/2016 | Trombetta |
| D751,382 | S | 3/2016 | Torrison |
| 9,278,787 | B2 | 3/2016 | Garg |
| 9,352,886 | B2 | 5/2016 | Baillies |
| D761,104 | S | 7/2016 | Buck |
| 9,421,710 | B2 | 8/2016 | Drebes |
| 9,474,420 | B2 | 10/2016 | Oakes |
| 9,526,362 | B2 | 12/2016 | Wang |
| 9,546,018 | B1 | 1/2017 | Vovan |
| 9,561,885 | B1 | 2/2017 | Studee |
| 9,656,418 | B2 | 5/2017 | Kezios |
| 9,669,992 | B2 | 6/2017 | Temple, Jr. |
| D793,231 | S | 8/2017 | Langfelder |
| D793,899 | S | 8/2017 | Tilbrook |
| 9,717,651 | B2 | 8/2017 | Hohl |
| 9,814,334 | B2 | 11/2017 | Eickhoff |
| 9,815,239 | B2 | 11/2017 | Borse |
| 10,113,058 | B2 | 10/2018 | Bockman |
| D838,590 | S | 1/2019 | Lee |
| D838,591 | S | 1/2019 | Lee |
| 10,201,241 | B2 | 2/2019 | Eickhoff |
| D845,128 | S | 4/2019 | Eickhoff |
| 10,286,593 | B2 | 5/2019 | Topolkaraev |
| D850,260 | S | 6/2019 | Eickhoff |
| D867,873 | S | 11/2019 | Troudt |
| D876,233 | S | 2/2020 | Pan |
| 10,570,263 | B2 | 2/2020 | Wallis |
| 10,577,159 | B2 | 3/2020 | Peng |
| D885,911 | S | 6/2020 | Silva |
| D885,912 | S | 6/2020 | Silva |
| D907,997 | S | 1/2021 | Eickhoff |
| D911,168 | S | 2/2021 | Eickhoff |
| 11,014,722 | B2 | 5/2021 | Peng |
| 11,040,499 | B2 | 6/2021 | Eickhoff |
| D930,476 | S | 9/2021 | Bontrager |
| D944,083 | S | 2/2022 | Boggs |
| D945,264 | S | 3/2022 | Eickhoff |
| D953,161 | S | 5/2022 | Tang |
| D955,160 | S | 6/2022 | Liu |
| 11,433,591 | B2 | 9/2022 | Eickhoff |
| D976,105 | S | 1/2023 | Eickhoff |
| 11,548,701 | B2 | 1/2023 | Peng |
| D984,894 | S | 5/2023 | Eickhoff |
| D993,770 | S | 8/2023 | Eickhoff |
| D993,771 | S | 8/2023 | Eickhoff |
| 11,891,488 | B2 | 2/2024 | Peng |

(56) References Cited

U.S. PATENT DOCUMENTS

2001/0001376 A1 5/2001 Kneppe
2002/0027139 A1 3/2002 ONeill
2002/0037378 A1 3/2002 Littlejohn
2002/0184985 A1 12/2002 Ishibuchi
2002/0189957 A1 12/2002 Gordon
2003/0062272 A1 4/2003 Gordon
2003/0089714 A1 5/2003 Dart
2003/0089726 A1 5/2003 Mazzarolo
2003/0114288 A1 6/2003 Harding
2003/0155353 A1 8/2003 Tucker
2003/0170460 A1 9/2003 Sienkiewicz
2003/0192890 A1 10/2003 Mazzarolo
2004/0011803 A1 1/2004 Damato
2004/0094553 A1 5/2004 Crider
2004/0101703 A1 5/2004 Funaki
2004/0134911 A1 7/2004 Padovani
2004/0144676 A1 7/2004 Rider
2004/0159080 A1 8/2004 Stewart
2004/0178199 A1 9/2004 Stroup
2004/0217033 A1 11/2004 Gordon
2004/0222226 A1 11/2004 Gottainer
2004/0245261 A1 12/2004 Stanos
2005/0037168 A1 2/2005 Dalgewicz
2005/0051442 A1 3/2005 Gordon
2005/0082177 A1 4/2005 Weiss
2005/0092749 A1 5/2005 Durdon
2005/0109780 A1 5/2005 Pendergrass
2005/0155969 A1 7/2005 Clarke
2005/0167294 A1 8/2005 Swayne
2005/0178766 A1 8/2005 Washington
2005/0210085 A1 9/2005 Bessiere
2005/0224505 A1 10/2005 Brown
2005/0230406 A1 10/2005 Maravich
2005/0263413 A1 12/2005 Harman
2005/0269328 A1 12/2005 Crider
2006/0060589 A1 3/2006 Lee
2006/0071008 A1 4/2006 Sadlier
2006/0096983 A1 5/2006 Patterson
2006/0097516 A1 5/2006 Kozlowski
2006/0180028 A1 8/2006 Burchard
2006/0213908 A1 9/2006 Clarke
2006/0226148 A1 10/2006 Hundley
2006/0255038 A1 11/2006 Hollis
2007/0007298 A1 1/2007 Tucker
2007/0034629 A1 2/2007 Mazzarolo
2007/0062943 A1 3/2007 Bosworth
2007/0075080 A1 4/2007 Farnsworth
2007/0107578 A1 5/2007 Koelsch
2007/0246862 A1 10/2007 Jones
2008/0035681 A1 2/2008 Skillin
2008/0097516 A1 4/2008 Chang
2008/0105696 A1 5/2008 Dart
2008/0197134 A1 8/2008 Maxwell
2008/0230176 A1 9/2008 Van De Weijer
2008/0245792 A1 10/2008 Chou
2009/0026219 A1 1/2009 Bal
2009/0223961 A1 9/2009 Wang
2009/0266829 A1 10/2009 Bailey
2009/0272742 A1 11/2009 Dybala
2009/0308882 A1 12/2009 Hundley
2009/0313956 A1 12/2009 Martinez Sampedro
2010/0037780 A1 2/2010 Pas
2010/0255137 A1 10/2010 Mazzarolo
2010/0282400 A1 11/2010 Sekar
2011/0011863 A1 1/2011 Hollis
2011/0062173 A1 3/2011 Trotter
2011/0089187 A1 4/2011 Steiger
2011/0124817 A1 5/2011 Dias
2011/0272318 A1 11/2011 Gallop
2011/0284564 A1 11/2011 Hsieh
2011/0297573 A1 12/2011 Chen
2012/0024871 A1 2/2012 Hundley
2012/0048856 A1 3/2012 Walker
2012/0097690 A1 4/2012 Chien
2012/0113488 A1 5/2012 Machida
2012/0132699 A1 5/2012 Mann
2012/0208961 A1 8/2012 Carnahan
2012/0261417 A1 10/2012 Tabor
2012/0272622 A1 11/2012 Weiss
2012/0298032 A1 11/2012 Mazzarolo
2013/0020338 A1 1/2013 French
2013/0037558 A1 2/2013 Selina
2013/0142975 A1 6/2013 Wallace
2013/0277380 A1 10/2013 Koestring
2014/0072674 A1 3/2014 Holinda, Jr.
2014/0224805 A1 8/2014 Merbach
2014/0238583 A1 8/2014 Sekar
2014/0238584 A1 8/2014 Sekar
2014/0263378 A1 9/2014 Bolek
2014/0284344 A1 9/2014 French
2014/0325715 A1 10/2014 Wendeln
2015/0014090 A1 1/2015 Masor
2015/0021345 A1 1/2015 Wu
2015/0094406 A1 4/2015 Miley
2015/0191282 A1 7/2015 Crudgington
2015/0216342 A1 8/2015 Tabor
2015/0251818 A1 9/2015 Strachan
2015/0337059 A1 11/2015 St Jean
2015/0344647 A1 12/2015 Maeda
2015/0367566 A1 12/2015 Schwab
2016/0000243 A1 1/2016 Tedford, Jr.
2016/0000269 A1 1/2016 Van Puijenbroek
2016/0016389 A1 1/2016 Dias
2016/0016702 A1 1/2016 Siskindovich
2016/0058223 A1 3/2016 Savenok
2016/0075487 A1 3/2016 Lin
2016/0081280 A1 3/2016 Moore
2016/0090218 A1 3/2016 Sun
2016/0107786 A1 4/2016 Lin
2016/0113424 A1* 4/2016 Eickhoff ..... B65D 47/0833 222/545
2016/0137364 A1 5/2016 Pirrella
2016/0160004 A1 6/2016 Skaggs
2016/0167855 A1 6/2016 Umbarger
2016/0318686 A1 11/2016 Russell
2016/0355327 A1 12/2016 Minganti
2017/0008187 A1 1/2017 Iwai
2017/0029189 A1 2/2017 Sanders
2017/0043913 A1 2/2017 Strachan
2017/0121089 A1 5/2017 Gillblad
2017/0137159 A1 5/2017 Sullivan
2018/0022012 A1 1/2018 Rapparini
2018/0050826 A1 2/2018 Hartman
2018/0127161 A1 5/2018 Smith
2018/0133919 A1 5/2018 Waterman
2018/0290798 A1 10/2018 Peng
2019/0039328 A1 2/2019 Eickhoff
2020/0024039 A1* 1/2020 Chou ..... B65D 43/0212
2020/0029712 A1 1/2020 O'Nan
2020/0055640 A1 2/2020 Lee
2020/0247034 A1 8/2020 Eickhoff
2020/0247967 A1 8/2020 Peng
2021/0047083 A1 2/2021 Eickhoff
2021/0253318 A1 8/2021 Waterman
2022/0041341 A1 2/2022 Eickhoff
2022/0097925 A1 3/2022 Baird
2023/0105117 A1 4/2023 Waterman

FOREIGN PATENT DOCUMENTS

CN 99813627 1/1999
CN 99813014 9/1999
DE 20116771 U1 12/2001
DE 20301404 U1 4/2003
DE 202016006730 U1 2/2018
EP 0934893 A1 8/1999
EP 1319493 A1 6/2003
EP 1464458 B1 10/2004
EP 1208958 B1 1/2006
EP 1837138 B1 9/2007
FR 2484903 A1 12/1981
GB 1496299 A 12/1977
JP H09171322 A 6/1997
JP 11040499 A 2/1999

(56) References Cited

FOREIGN PATENT DOCUMENTS

| | | | |
|---|---|---|---|
| JP | 2002104686 | A | 4/2002 |
| JP | 2002210616 | A | 7/2002 |
| JP | 2002210818 | A | 7/2002 |
| JP | 2002241514 | A | 8/2002 |
| JP | 2002241515 | A | 8/2002 |
| JP | 2004025802 | A | 1/2004 |
| JP | 2004106519 | A | 4/2004 |
| JP | 2009281529 | A | 12/2009 |
| WO | 1999017923 | A1 | 4/1999 |
| WO | 0018662 | | 4/2000 |
| WO | 0018663 | | 4/2000 |
| WO | 0185575 | | 11/2001 |
| WO | 03011716 | | 2/2003 |
| WO | 2004014776 | | 2/2004 |
| WO | 2005013247 | A1 | 2/2005 |
| WO | 2010018749 | A1 | 2/2010 |
| WO | 2011149583 | A2 | 12/2011 |

OTHER PUBLICATIONS

Extended European Search Report for EP 20852216.9 dated Sep. 11, 2023, 7 pages.
European Extended Search Report for EP23180774.4 dated Sep. 25, 2023, 9 pages.
Office Action dated Sep. 22, 2023 for U.S. Appl. No. 29/896,014 (pp. 1-9).
12SL Foam Cup Straw Lid: Announced (May 24, 2019 online). Site visited (Sep. 18, 2023). Available from URL: https://www.mrplasticsinc.com/12oz-foam-cup-straw-slotted-lid-match-12j12-1000ps.
PET Thermoform Flat Lid with FLavor Buttons: Site Visited (Sep. 14, 2023; online). Available from URL: https://www.berryglobal.com/en/product/lids/47inches-pet-thermoform-flat-lid-with-flavor-buttons-13183158.
Fabri-Kal Greetware: Site Visited (Sep. 18, 2023). Available from URL: https://www.officedepot.com/a/products/1639774/ Fabri-Kal-Greenware-Cold-Drink-Cup/.
Office Action dated Sep. 22, 2023 for U.S. Appl. No. 29/896,017 (pp. 1-9).
Office Action dated Oct. 10, 2023 for U.S. Appl. No. 29/798,668, (pp. 1-10).
Office Action dated Jul. 5, 2023 for U.S. Appl. No. 16/782,165, (pp. 1-7).
Office Action (Final Rejection) dated Jul. 5, 2023 for U.S. Appl. No. 16/782,165 (pp. 1-14).
Office Action (Non-Final Rejection) dated Dec. 21, 2023 for U.S. Appl. No. 17/395,182, (pp. 1-13).
Office Action (Non-Final Rejection) dated Dec. 21, 2023 for U.S. Appl. No. 18/127,353, (pp. 1-19).
Office Action (Non-Final Rejection) dated Jan. 31, 2024 for U.S. Appl. No. 18/217,763 (pp. 1-10).
Canadian Examination Report for Canadian Patent App. No. 3,129,224 dated Jan. 17, 2025, 3 pages.
Canadian Examiner's Report for Canadian App. No. CA3129416 dated Feb. 7, 2025, 4 pages.
European Examination Report for European App. No. 20753137.7 dated Apr. 15, 2025, 5 pages.
English translation of JP-2009281529-A by EPO. (Year: 2009).
Office Action (Final Rejection) dated May 22, 2025 for U.S. Appl. No. 18/125,308 (pp. 1-33).
Office Action (Non-Final Rejection) dated Jun. 18, 2024 for U.S. Appl. No. 17/856,124, (pp. 1-10).
Extended European Search Report for European Patent App. No. EP21853805.6 dated Jul. 23, 2024, 8 pages.
Kocsis et al. The Polypropylene Handbook (Year: 2018).
Entec Stress Whitening in Polypropylene (Year: 2020).
Office Action (Non-Final Rejection) dated Jul. 17, 2024 for U.S. Appl. No. 18/399,886 (pp. 1-21).
Extended European Search Report for European Patent App. No. EP24204859.3 dated Nov. 12, 2024, 8 pages.
Canadian Office Action for Canadian App. No. 3072302 sent Sep. 23, 2024, 3 pages.
Office Action (Non-Final Rejection) dated Dec. 12, 2024 for U.S. Appl. No. 18/125,308 (pp. 1-26).
European Search Report for European Patent App. No. EP24204859.3 dated Jul. 31, 2025, 3 pages.
International Search Report for PCT/US06/32565, dated May 24, 2007.
Supplementary Search Report dated Apr. 6, 2009.
International Search Report and Written Opinion dated Jul. 9, 2008, for PCT/US2008/054888.
Supplementary European Search Report dated Jul. 28, 2008, for European Patent Application No. 06813520.1.
International Search Report and Written Opinion for International Application No. PCT/US2014/006277, Jul. 15, 2014, 8 pages.
Notice of Non-Final Rejection for U.S. Appl. No. 13/448,050, Oct. 8, 2014, 13 pages.
Notice of Non-Final Rejection for U.S. Appl. No. 13/554,771, Jun. 7, 2013, 14 pages.
Notice of Non-Final Rejection for U.S. Appl. No. 14/214,236, Oct. 3, 2014, 10 pages.
PCT International Search Report and Written Opinion completed by the ISA/US on Jun. 19, 2014 and issued in connection with PCT/US2014/027067.
Chinse Office Action for Chinese Patent Application 201480010419.3 dated Jul. 19, 2016, 8 pages.
Extended European Search Report for European Patent Application No. 14768275.1, mailed Sep. 14, 2016, 7 pages.
Office Action dated Sep. 30, 2016 for U.S. Appl. No. 14/214,236.
Chinese Office Action for Chinese App. No. 201480010419.3 dated Dec. 22, 2016, 4 pages.
Office Action dated Apr. 3, 2017 for U.S. Appl. No. 14/921,540.
Australian Search Report for Australian App. No. 2014240016 sent Mar. 17, 2017, 3 pages.
Office Action dated May 15, 2017 for U.S. Appl. No. 14/214,236.
Singapore Written Opinion for Singapore Patent App. No. 11201507343Y dated Sep. 6, 2017, 6 pages.
Office action dated Jun. 14, 2017 for U.S. Appl. No. 14/921,540; (pp. 1-8).
Australian Search Report for Australian App. No. 2014240016 sent Aug. 25, 2017, 3 pages.
Office Action mailed Oct. 6, 2017 for U.S. Appl. No. 15/485,299; (pp. 1-5).
Japanese Office Action for Japanese App. No. 2016-502328 sent Oct. 3, 2017, 11 pages.
Office Action dated Jan. 16, 2018 for U.S. Appl. No. 14/214,236; (pp. 1-13).
Russian Office Action and Search Report for Russian App. No. 2015134775 sent on Mar. 13, 2018, 10 pages.
Japanese Office Action for Japanese App. No. 2016-502328 sent Mar. 6, 2018, 4 pages.
Emvato Tuts+. Create a Set of Flat Precious Gems Icons in Adobe Illustrator by Yulia Sokolova. Apr. 9, 2014 [earliest online date], [site visited Feb. 22, 2018]. Available from Internet, <URL:https://design.tutsplus.com/tutorials/ create-a-set-of-flat-precious-gems-icons-in-adobe-illustrator--vector-26188>. (Year: 2014), 77 pages.
Office Action dated Apr. 4, 2018 for U.S. Appl. No. 29/599,942 (pp. 1-5).
Infinity Blade Wiki. Hexagon gem. Nov. 17, 2013 [earliest online date], [site visited Feb. 22, 2018]. Available from Internet, <URL:http://infinityblade.wikia.conn/wiki/Hexagon gem>. (Year: 2013), 1 page.
Office Action dated Apr. 4, 2018 for U.S. Appl. No. 29/599,948 (pp. 1-5).
Office Action dated Apr. 16, 2018 for U.S. Appl. No. 15/485,299, (pp. 1-4).
Office Action dated Jul. 10, 2018 for U.S. Appl. No. 15/172,650, (pp. 1-9).
Office Action dated Jul. 5, 2018 for U.S. Appl. No. 29/599,942, (pp. 1-4).
Blogspot. The Herman Letters. Jul. 12, 2011 [earliest online date], [site visited Jul. 23, 2018]. Available from Internet, <URL: http://theherrnanletters.blogspot.corn/2011/07/ipost-190-is-rncdonalds-selling-p.htrnl>. (Year: 2011).

(56) References Cited

OTHER PUBLICATIONS

Office Action dated Jul. 27, 2018 for U.S. Appl. No. 29/599,948, (pp. 1-5).
Office Action dated Nov. 30, 2018 for U.S. Appl. No. 29/599,948, (pp. 1-5).
Office Action dated Jan. 7, 2019 for U.S. Appl. No. 15/172,650, (pp. 1-9).
International (PCT) Search Report and Written Opinion for PCT App. No. PCT/US18/264467 mailed Jul. 3, 2018, 11 pages.
International (PCT) Search Report and Written Opinion for PCT/US18/45575 established Oct. 19, 2018, 13 pages.
Office Action dated Sep. 12, 2019 for U.S. Appl. No. 15/946,023, (pp. 1-15).
First Examination Report for Indian App. No. 8804/DELNP/2015 sent Oct. 30, 2019, 6 pages.
Office Action mailed Mar. 19, 2020, for U.S. Appl. No. 15/172,650, (pp. 1-11).
Office Action dated Mar. 19, 2020, for U.S. Appl. No. 15/172,650 (pp. 1-11).
Third Party Submission Under 37 CFR 1.290 in U.S. Appl. No. 16/057,122, dated Apr. 16, 2020, 49 pages.
International Search Report and Writen Opinion dated Apr. 29, 2020, 11 pages.
International (PCT) Search Report and Written Opinion for PCT/2020/016769 dated May 27, 2020, 12 pages.
Office Action dated Aug. 6, 2020 for U.S. Appl. No. 16/736,849, (pp. 1-18).
Office Action dated Aug. 20, 2020 for U.S. Appl. No. 16/057,122, (pp. 1-20).
Polymer Properties of Omnexus—Transparency (https://web.archive.Org/web/20170406012756/https://omnexus.specialchem.com/ polymer-properties/properties/transparency, available in public at least on or after Apr. 6, 2017) (Year: 2017).
Solo 668NS: Site Visited [Apr. 30, 2020]. Available from Internet URL: https://www.dartcontainer.com/products/foodservice-catalog/accessories/lids/solo-pet-plastic-flat-cold-cup-lids/668ns/ 1/2.
Single Use Spill REsistant Flat Lid_Berry Global: Site Visited [Apr. 30, 2020]. Available from Internet URL: https:// catalog.berryglobal .com/products/lid/liddrink/dlt308srcp.
Thermoform Strawless Lid with Straw Slot_Berry Global: Site Visited [Apr. 30, 2020]. Available from Internet URL: https:// catalog.berryglobal .com/products/lid/liddrink/dlt402ssl p.
Office Action (Non-Final Rejection) dated Mar. 16, 2023 for U.S. Appl. No. 16/782,165, (pp. 1-14).
Office Action dated Apr. 13, 2023 for U.S. Appl. No. 29/798,668, (pp. 1-9).
Polymer Properties of Omnexus—Haze (https://web.archive.Org/web/20170519201652/https://omnexus.specialchem.com/ polymer-properties/properties/haze, available in public at least on or after May 19, 2017) (Year: 2017).
Impact Plastics Blog (http://blog.impactplastics-ct.com/blog/basic-guide-to-the-three-main-grades-of-polypropylene-resin, available in public from the date May 16, 2017) (Year: 2017).
Canadian Filing of Prior Art Under Section 34.1(1) of the Canadian Patent Act by Third Party, Aug. 7, 2020, 20 pages.
Chartier Octagonal Wall Modern and Contemporary Accent Mirror: Site Visited [Sep. 14, 2020. Available from Internet URL: https:// www.wayfair.com/decor-pillows/pdp/eichholtz-chartier-octagonal-wall-modern-and-contemporary-accent-mirror-eitz2666.html.
Nathan Wall Mounted Mirror: Announced Jul. 2, 2020 [online]. Site Visited [Sep. 14, 2020], Available from Internet URL: https://www.wayfair.com/decor-pillows/pdp/house-of-hampton-nathan-wall-mounted-mirror-hmpt5079.html.
Office Action dated Dec. 30, 2020 for U.S. Appl. No. 15/172,650, (pp. 1-24).
International (PCT) Search Report and Written Opinion for PCT/US20/46469 dated Nov. 30, 2020, 9 pages.
European Search Report for European App. No. 18780978.5 dated Jan. 28, 2021, 8 pages.
European Search Report for European App. No. 18844658.7 dated Apr. 4, 2021, 11 pages.
Office Action dated Jul. 1, 2021 for U.S. Appl. No. 15/172,650, (pp. 1-6).
First Chinese Office Action for Chinese Patent App. No. 20180065303.8 dated Jun. 15, 2021, 12 pages.
European First Substantive Examination Report for European App. No. 18780978.5 dated Aug. 24, 2021, 4 pages.
Office Action dated Nov. 23, 2021 for U.S. Appl. No. 16/782,203, (pp. 1-36).
"Polymers and Environment," by Ojeda, available at https://www.intechopen.com/chapters/42104, published on Jan. 23, 2013. ( Year: 2013).
Office Action dated Jan. 14, 2022 for U.S. Appl. No. 29/761,992, (pp. 1-8).
Octagonal Wall Mirror: Announced Aug. 26, 2019 [online]. Site Visite [Jan. 10, 2022. Available from Internet URL: https://www.wayfair.com/decor-pillows/pdp/house-of-hampton-nathan-wall-mounted-mirror-hmpt5079.html, 16 pages.
European Examination Report for EP 18780978.5 dated Nov. 25, 2022, 5 pages.
International (PCT) Search Report and Written Opinion for PCT/US21/44766 dated Jan. 11, 2022, 14 pages.
Second Chinese Office Action for Chinese Patent App. No. 20180065303.8 dated Jun. 24, 2022, 9 pages.
Thermoform Spill Resistant Flat Lid: Site Visited [Feb. 15, 2022]. Available from Internet URL: https://catalog.berryglobal.com/ products/lid/liddrink/dlt408srcp.
Office Action dated Feb. 22, 2022 for U.S. Appl. No. 29/765,808, (pp. 1-8).
Chinese Rejection Decision for Chinese Patent App. No. 20180065303.8 dated May 27, 2022, 12 pages.
European Search Report for European App. No. 20753137.7 dated Sep. 1, 2022, 6 pages.
Office Action dated Aug. 26, 2022 for U.S. Appl. No. 29/765,808, (pp. 1-5).
European Search Report for European App. No. 20753051.0 dated Sep. 23, 2022, 15 pages.
Solo PET Plastic Flat Cold Cup Lids: Announced (Oct. 28, 2020 (online)) Site Visited (Sep. 20, 2022). Available from Internet URL: https://www.dartcontainer.com/products/foodservice-catalog/accessories/lids/solo-pet-plastic-flat-cold-cup-lids/668ns/.
Office Action (Non-Final Rejection) dated Oct. 5, 2022 for U.S. Appl. No. 17/550,292 (pp. 1-13).
International (PCT) Search Report and Written Opinion for PCT/US2022/035911 dated Oct. 5, 2022, 8 pages.
DART Hot/Cold Cup Lid: Site Visited (Nov. 30, 2022). Available from URL: : https://www.grainger.com/product/1UCV4?gucic :N:PS:Paid:GGL:CSM-2295:4P7A1P:20501231&gclid=EAIaIQobChMIps6Jzu7W-wIVIYXICh0npwZYEAKYCyABEgKSkfD_BwE& gclsrc=aw.ds.
Dixie Long-Skirt Selector Lid: Site Visited (Nov. 30, 2022). Available from URL: https://caljaninc.com/catalog/p/DXE- 914LSRD/Dixie-Long-Skirt-Selector-Lid-For-12-16-21-oz/.
Office Action dated Dec. 8, 2022 for U.S. Appl. No. 29/843,255, (pp. 1-8).
Office Action dated Dec. 8, 2022 for U.S. Appl. No. 29/843,256, (pp. 1-8).
Supplementary European Search Report for European App. No. 20753051.0 dated Jan. 3, 2023, 13 pages.
Third Chinese Office Action for Chinese App. No. 201880065303.8 dated Jan. 5, 2023, 12 pages.
Black Plastic Straw: Announced (May 19, 2022; online). Site Vistied (Dec. 17, 2022). Available from URL: https:// www.restaurantware.com/disposables/coffee-cups-accessories/coffee-cup-lids/black-plastic-2-in-1-straw-or-sip-coffee-cup-lid-fits-8- 12-16-and-20-oz-100-count-box/.
Black Flip Top Hot Cup Lid: Announced (Sep. 9, 2020 (online)). Site Visited (Dec. 17, 2022). Available from URL: https://hotcupfactory.com/collections/hot-cup-lids/products/black-flip-top-hot-cup-lids-8-10-12-16-20-22-oz.
English translation of JP-2004025802-A by EPO (OA Appendix) (Year: 2004).

(56) References Cited

OTHER PUBLICATIONS

English translation of JP-2002210818-A by EPO (OA Appendix) (Year: 2002).
International (PCT) Preliminary Report on Patentability dated Feb. 7, 2023, 10pages.

* cited by examiner

DRINK CUP LID

PRIORITY CLAIM

This application is a continuation of U.S. patent application Ser. No. 16/993,493, filed Aug. 14, 2020, and claims priority under 35 U.S.C. § 119(e) to U.S. Provisional Application No. 62/887,252, filed Aug. 15, 2019, each of which is expressly incorporated by reference herein.

BACKGROUND

The present disclosure relates to drink cups, and particularly to lids for drink cups. More particularly, the present disclosure relates to a lid with an opening for removing liquid from the drink cup and a closure that blocks the opening.

SUMMARY

According to the present disclosure, a liquid container comprises a lid adapted to mate with the brim of a cup. The cup also includes a floor and a side wall extending from the brim toward the floor.

In illustrative embodiments, the lid includes a central closure formed to include the liquid-discharge outlet and a ring-shaped brim mount arranged to surround the central closure. The brim mount of the lid is configured to mate with the brim of the cup to hold the central closure in a stationary position closing a cup mouth opening into an interior liquid reservoir chamber formed in the cup and placing the liquid-discharge outlet in fluid communication with any liquid stored in the interior liquid reservoir chamber of the cup.

In illustrative embodiments, the central closure includes an upstanding drink spout having a top wall that is formed to include the liquid-discharge outlet. An outlet closure is coupled to the drink spout for pivotable movement about a horizontal pivot axis between a closed position blocking access to the liquid-discharge outlet and an opened position spaced apart from the liquid-discharge outlet.

In illustrative embodiments, the lid is made from a thermoformed sheet of polypropylene. The lid is formed to have a low profile and a thickness of the lid is minimized to reduce an overall weight of the lid thereby saving material. The outlet closure includes a reinforcement structure to rigidify the outlet closure to reduce unwanted bending of the outlet closure due to the reduction in material used to form the lid. The reinforcement structure stiffens the outlet closure so that when a consumer pivots the outlet closure from the closed position to the opened position, the outlet closure is aligned with an outlet closure retainer that is used to hold the outlet closure in the opened position so that the consumer can drink from the liquid-discharge outlet.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 9:
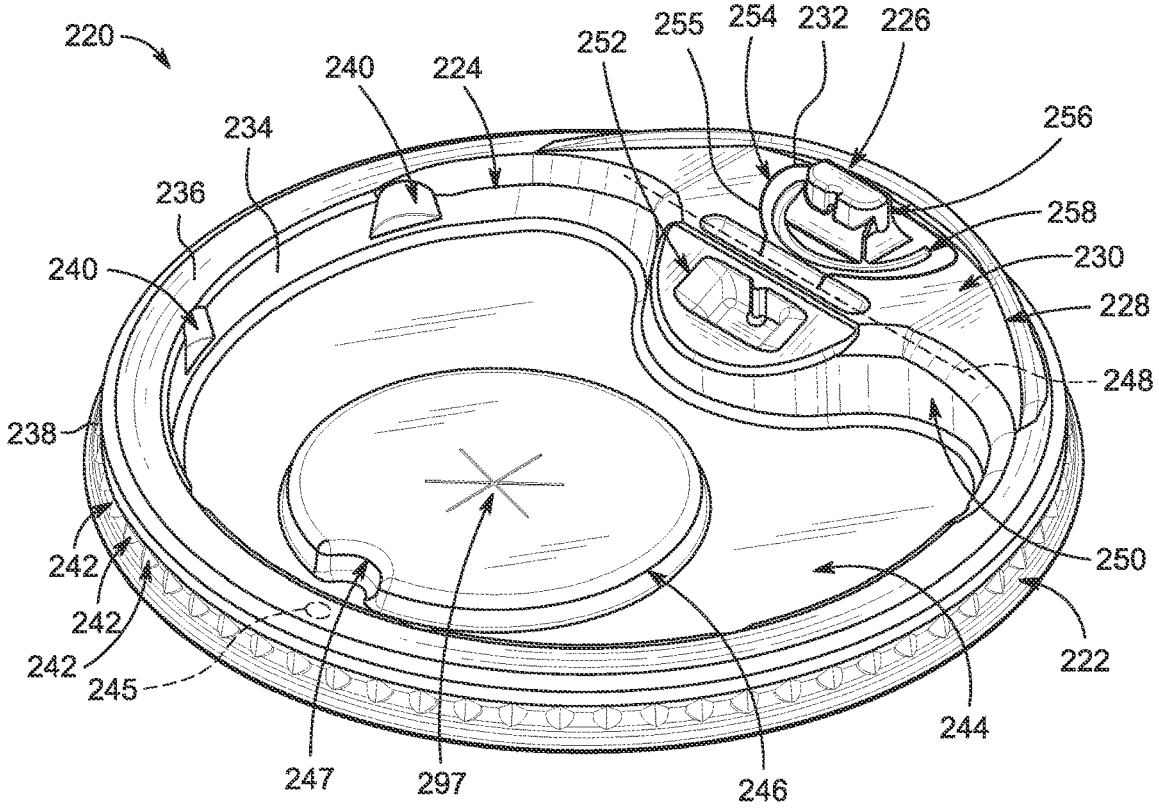
FIG. 9 is a perspective view of a second embodiment of a lid in accordance with the present disclosure including a straw opening.
Figure 10:
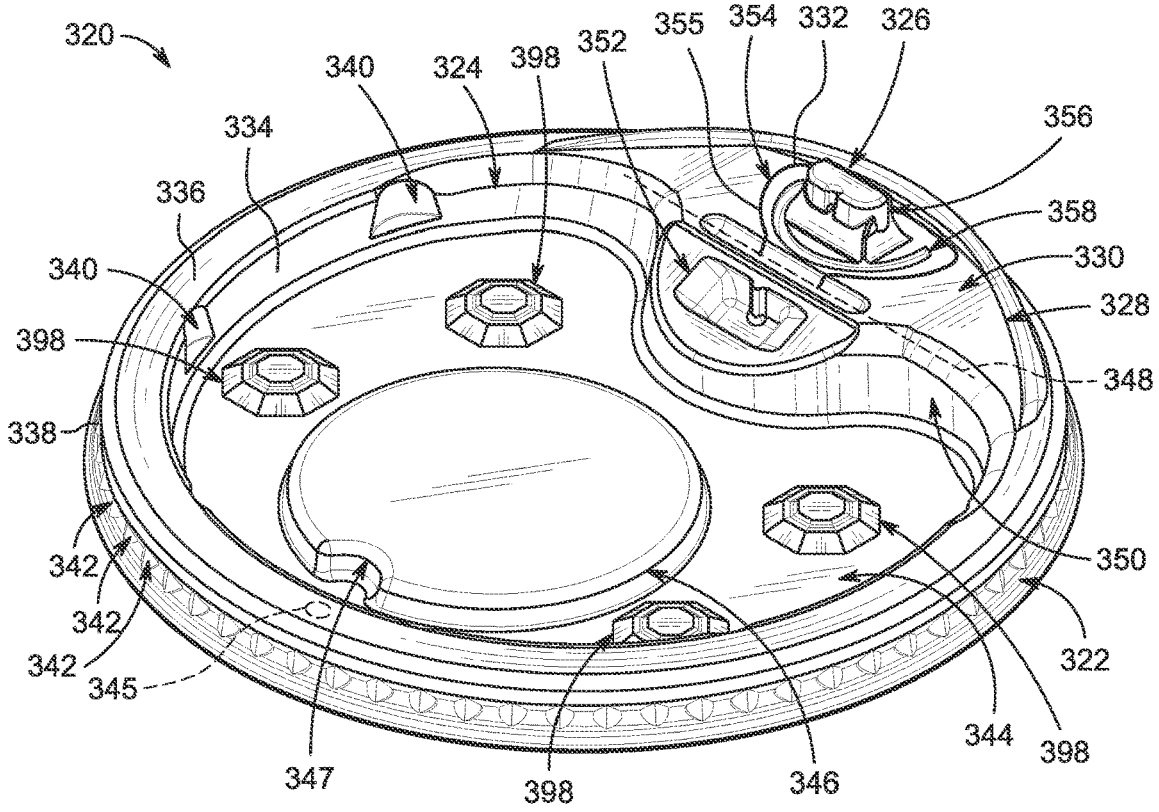
FIG. 10 is a perspective view of a third embodiment of a lid in accordance with the present disclosure including a plurality of flavor buttons.
Figure 11:
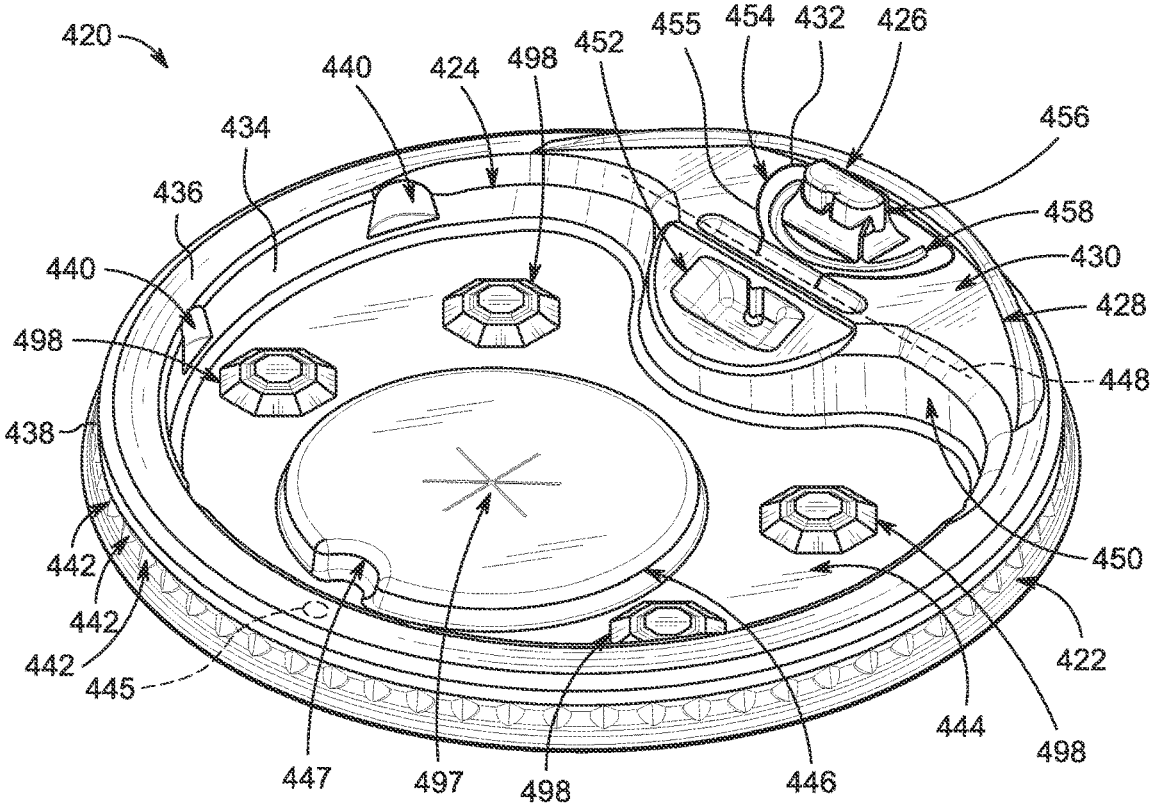
FIG. 11 is a perspective view of a fourth embodiment of a lid in accordance with the present disclosure including a straw opening and a plurality of flavor buttons.
Figure 12:
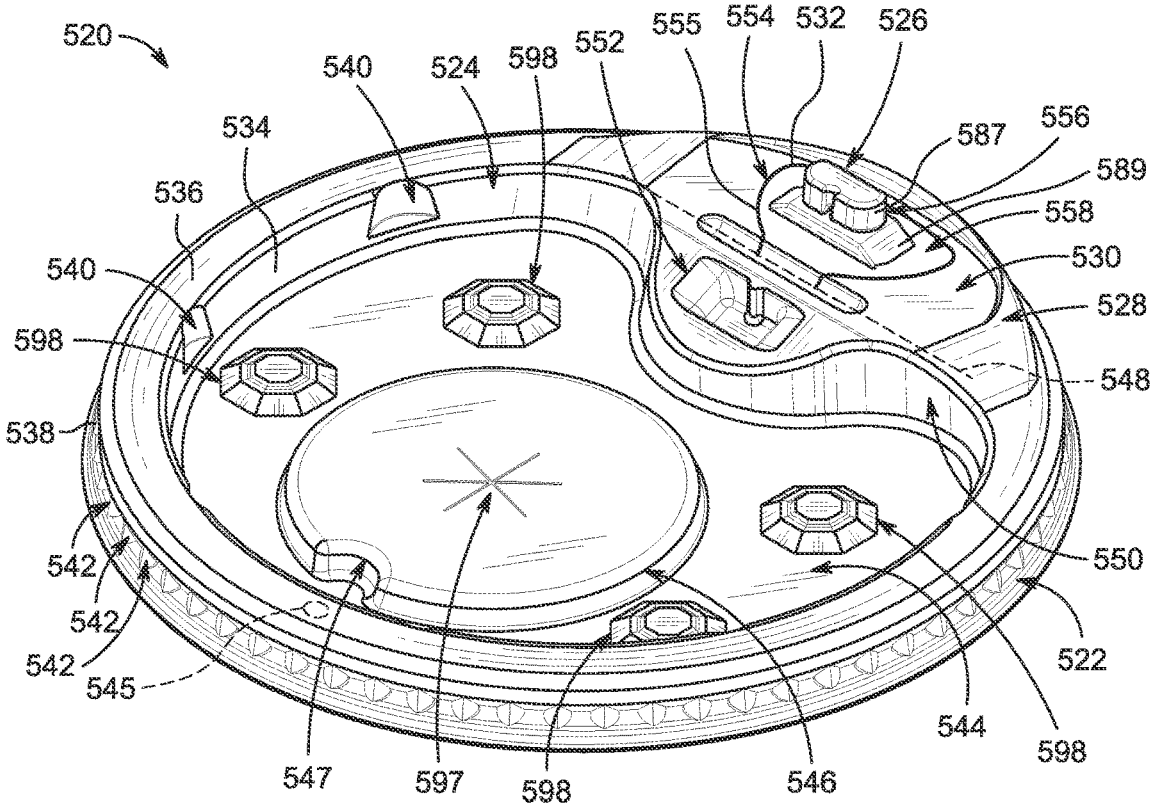
FIG. 12 is a perspective view of a fifth embodiment of a lid in accordance with the present disclosure including an upstanding drink spout with an outlet closure that is different from the outlet closure of the lids shown in FIGS. 1-11.

A liquid container 10 in accordance with the present disclosure includes a cup 12 having a brim 14 and a lid 20 that is configured to mate with the brim 14 of the cup 12 using an interference fit to cover an interior liquid reservoir chamber 15 of the cup 12. A first illustrative embodiment of a container 10 including lid 20 is shown in FIGS. 1-8. A second illustrative embodiment of a lid 220 that can be used with cup 12 is shown in FIG. 9. A third illustrative embodiment of a lid 320 that can be used with cup 12 is shown in FIG. 10. A fourth illustrative embodiment of a lid 420 that can be used with cup 12 is shown in FIG. 11. A fifth illustrative embodiment of a lid 520 that can be used with cup 12 is shown in FIG. 12. Other views of lids in accordance with the present disclosure are shown in FIGS. 13-52.

Figure 1:
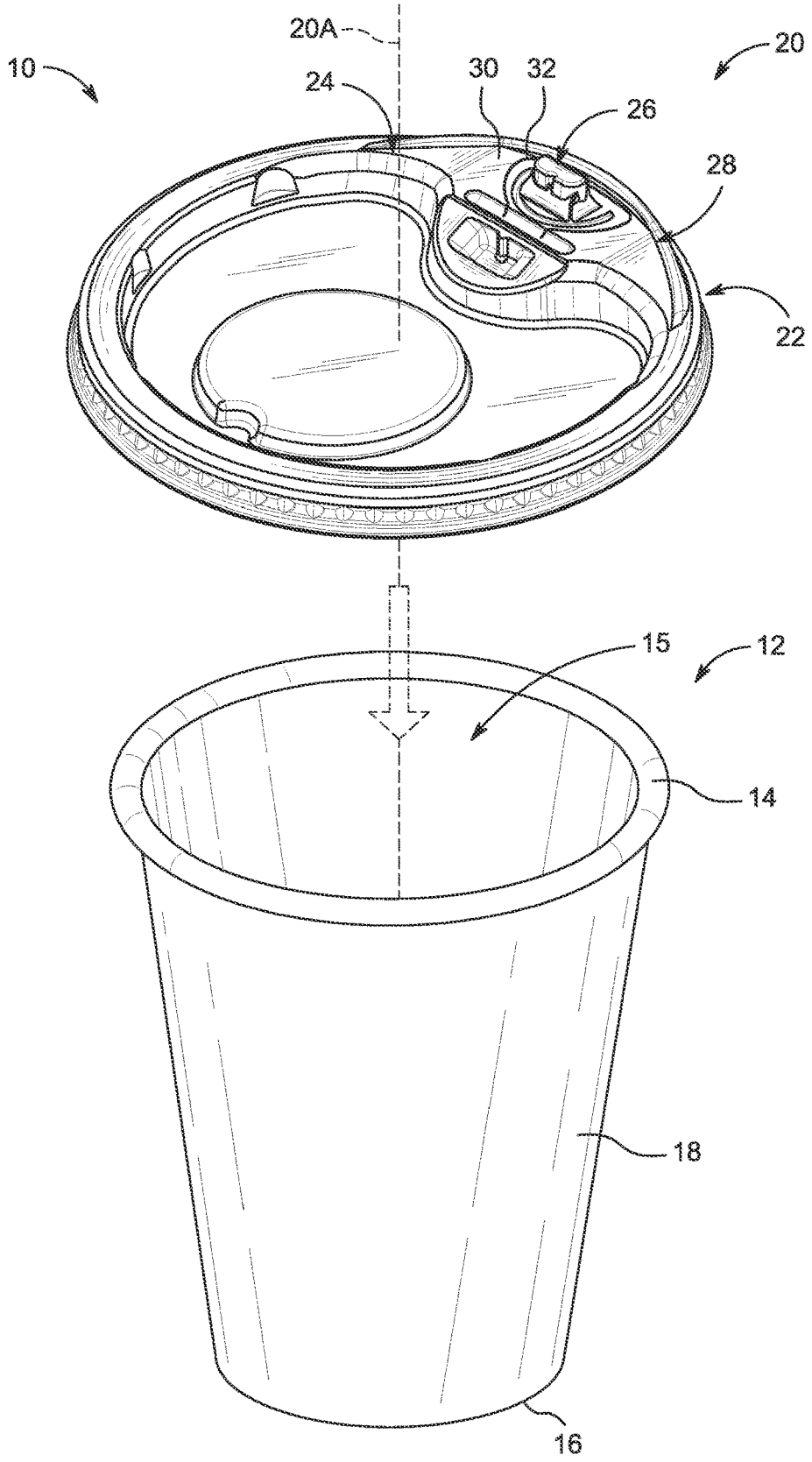
FIG. 1 is a perspective view of a lid in accordance with a first embodiment of the present disclosure and a cup before the lid is mounted on the cup and showing that the lid includes a central closure surrounded by a brim mount and an upstanding drink spout that is formed to include a liquid-discharge outlet and includes an outlet closure movable about a horizontal pivot axis between a closed position blocking access to the liquid-discharge outlet, as shown in FIG. 2, and an opened position where the outlet closure is spaced apart from the liquid-discharge outlet and retained in the opened position by an outlet closure retainer formed in the upstanding drink spout, as show in FIGS. 5 and 8.

Cup 12 includes a brim 14, a floor 16, and a side wall 18 extending upwardly from floor 16 to brim 14 as shown in FIG. 1. Side wall 18 and floor 16 cooperate to form interior liquid reservoir chamber 15 of cup 12. It is within the scope of this disclosure to make cup 12 out of any suitable plastics, paper, combinations thereof, and other material(s). It is within the scope of this disclosure to mount floor 16 in a suitable location at or near a lower edge of side wall 18.

Figure 2:
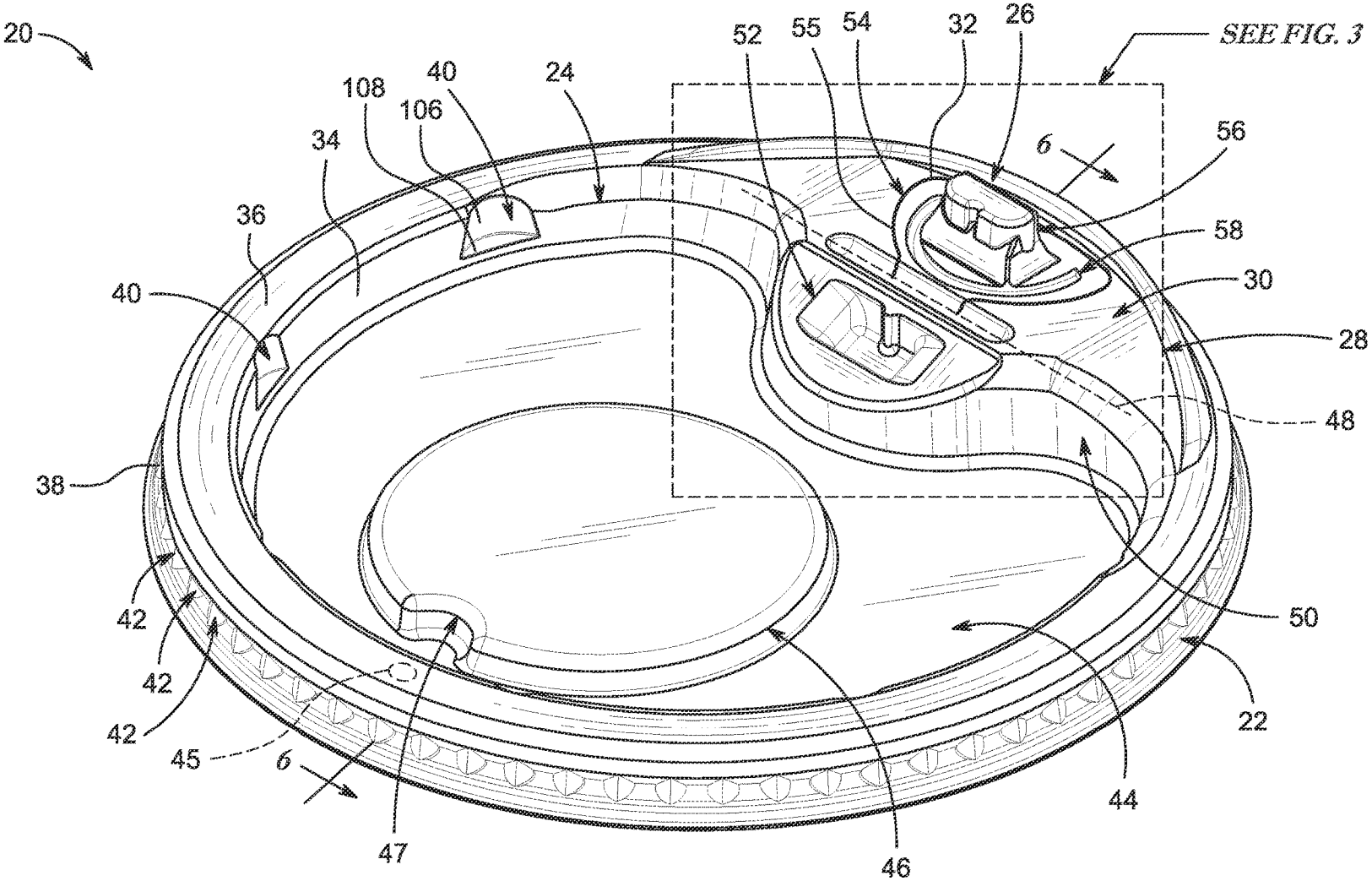
FIG. 2 is an enlarged perspective view of the lid with the outlet closure in the closed position.
Figure 3:
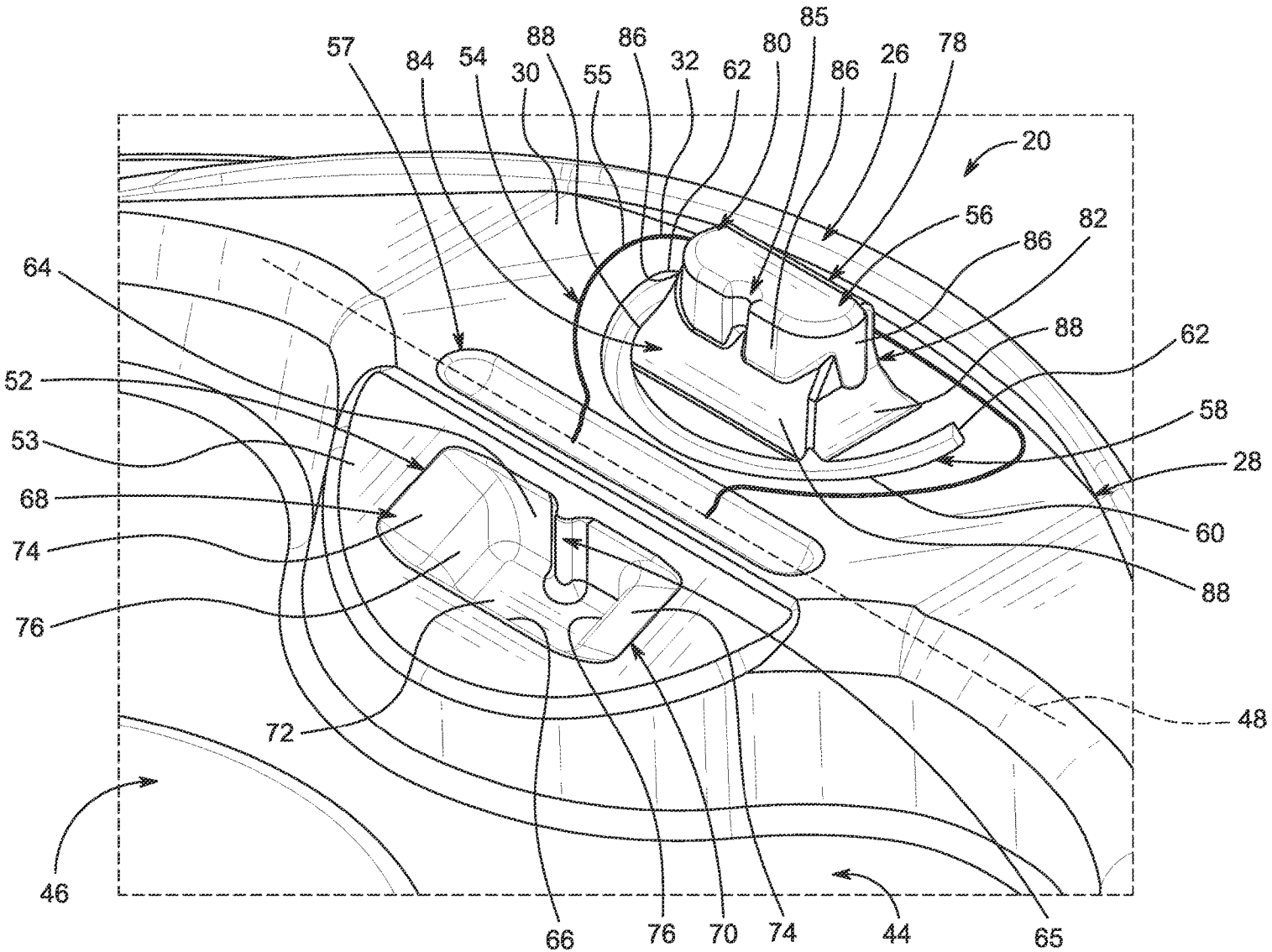
FIG. 3 is an enlarged portion of FIG. 2 showing the outlet closure and the outlet closure retainer in detail, the outlet closure including an outlet-closure skirt that matches a shape of the liquid-discharge outlet and an outlet-closure pedestal that extends upwardly away from the outlet-closure skirt and has a shape that corresponds with the outlet-closure retainer.
Figure 4:
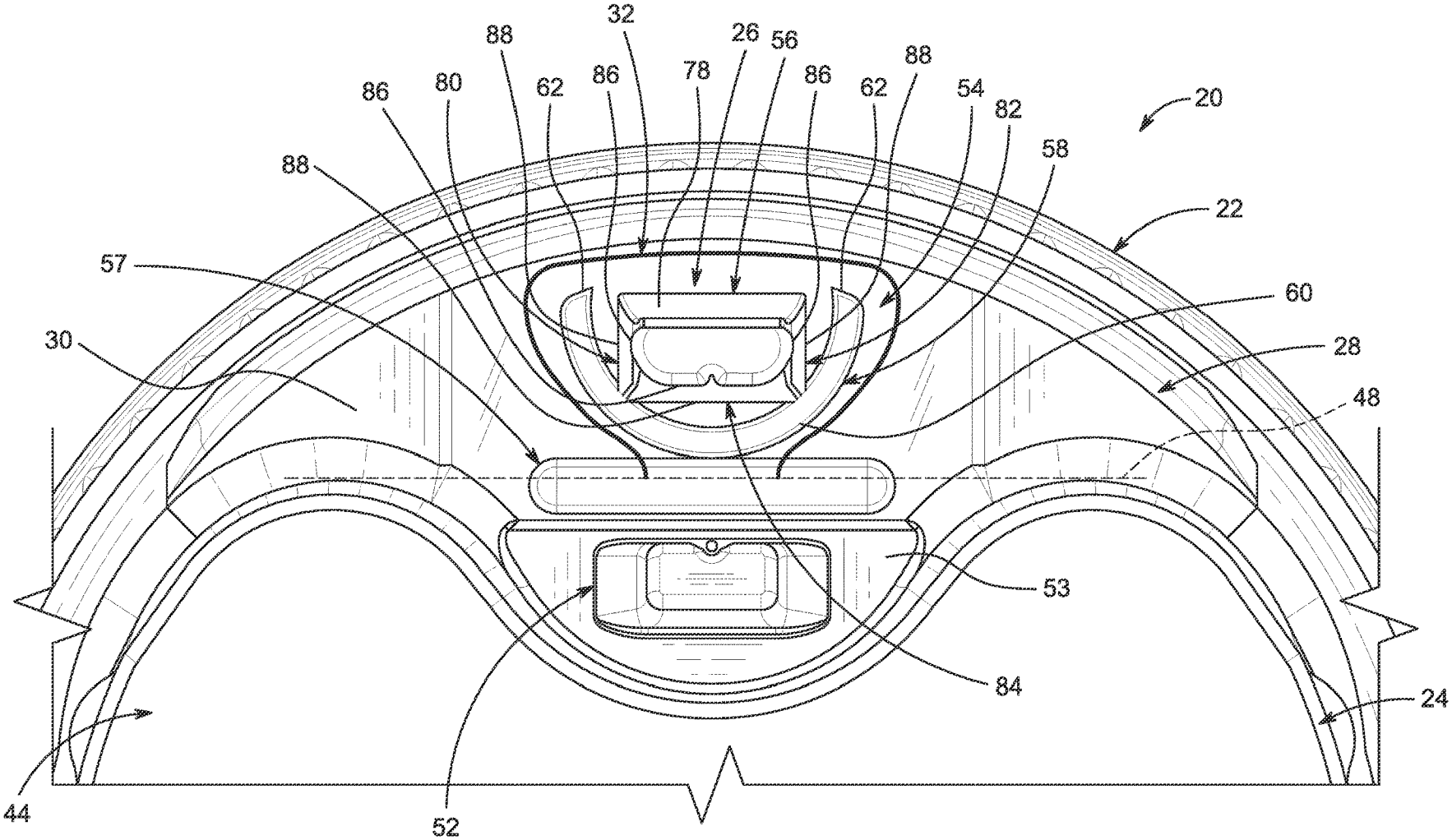
FIG. 4 is a top plan view of a portion of the lid showing that the outlet closure further includes an arcuate reinforcement rib that extends partway around the outlet-closure pedestal to increase a rigidity of the outlet closure so that the outlet closure pivots about the horizontal pivot axis when moving from the closed position to the opened position to ensure that the outlet-closure pedestal is aligned with the outlet-closure retainer when the outlet closure reaches the opened position.

Lid 20 may include any size suitable to coincide with brim 14 of cup 12 as suggested in FIG. 1 and includes a ring-shaped brim mount 22, a central closure 24, and an outlet closure 26 as shown in FIGS. 1-3. Brim mount 22 cooperates with brim 14 to provide a sealing interface to block flow of liquids between brim 14 and lid 20 when lid 20 is mounted on cup 12. Central closure 24 of lid 20 rises upwardly above brim mount 22 in illustrative embodiments and includes an upstanding drink spout 28 including a top wall 30 formed to include a liquid-discharge outlet 32 as suggested in FIGS. 1-3. Outlet closure 26 is sized and arranged to cover liquid-discharge outlet 32 until a consumer desires to remove liquid from the interior liquid reservoir chamber 15. In an illustrative embodiment, a consumer can drink liquid stored in cup 12 while lid 20 remains mounted on brim 14 of cup 12 through the liquid-discharge outlet 32 formed in lid 20. Drink spout 28 is adapted to be received in the mouth of a consumer desiring to drink a liquid stored in cup 12. Any liquid stored in interior liquid reservoir chamber 15 of cup 12 is in fluid communication with the liquid-discharge outlet 32 formed in top wall 30 of the upstanding drink spout 28 as suggested in FIG. 1.

Figure 7:
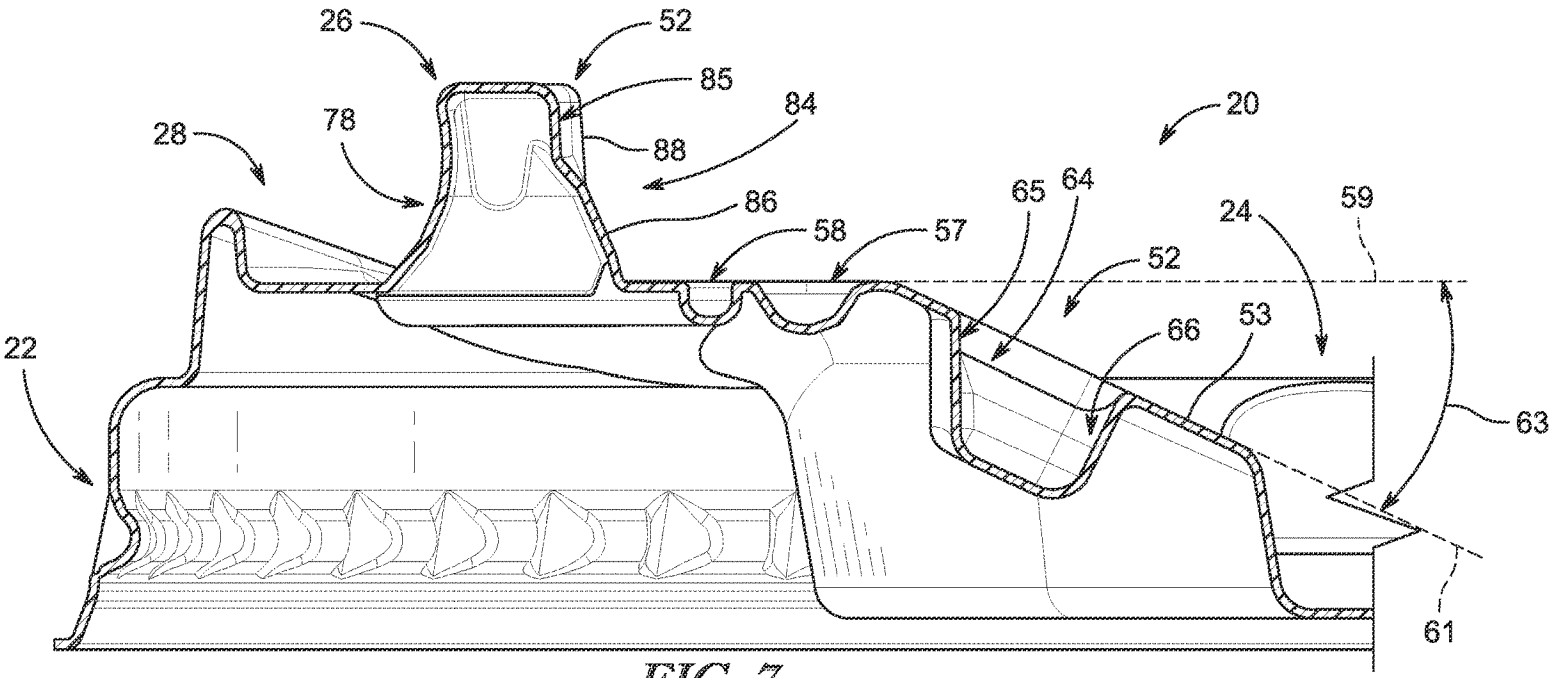
FIG. 7 is an enlarged portion of FIG. 6 showing the shape of the upstanding drink spout in detail.

Ring-shaped brim mount 22 includes an inner side wall 34, a top wall 36, and an outer side wall 38 as shown in FIG. 2. Inner side wall 34, top wall 36, and outer side wall 38 define an upside down U-shape when brim mount 22 is viewed in cross section as shown in FIG. 7. Inner side wall 34 is coupled to central closure 24. Top wall 36 provides an uppermost surface of the brim mount 22. Outer side wall 38 is spaced apart radially from inner side wall 34. Inner side wall 34, top wall 36, and outer side wall 38 are configured to engage different parts of brim 14 to establish multiple sealing interfaces with brim 14. Inner side wall 34 is formed to include a series of indents 40 while outer side wall 38 is formed to include a series of ribs 42. Indents 40 and ribs 42 may provide a more secure grip on brim 14 than a lid without indents 40 and/or ribs 42 and may facilitate stacking of multiple lids 20 for storage. Without indents 40 and/or ribs 42 there may be more engagement on the brim 14. The ribs 42 may provide relief from the interference and give rigidity to the brim mount 22 of the lid 20 when applying or removing the lid 20 from the brim 14 of the cup 12.

Central closure 24 is coupled to inner side wall 34 of brim mount 22 and forms an upper barrier to block liquids from flowing out of interior liquid reservoir chamber 15 until outlet closure 26 is removed from liquid-discharge outlet 32. Central closure includes drink spout 28, a central basin 44, and a plateau 46 as shown in FIG. 2. Drink spout 28 is coupled to central basin 44 and extends upwardly to a raised elevation above top wall 36 of brim mount 22. Drink spout 28 is the only structure of lid 20 that raises above top wall 36 to provide lid 20 with a low profile to minimize an overall weight of lid 20 as will be described in greater detail herein. Central basin 44 is coupled to inner side wall 34 of brim mount 22 and is arranged below top wall 36. Plateau 46 extends upwardly from central basin 44 and is also arranged to lie below top wall 36 of brim mount 22.

Figure 5:
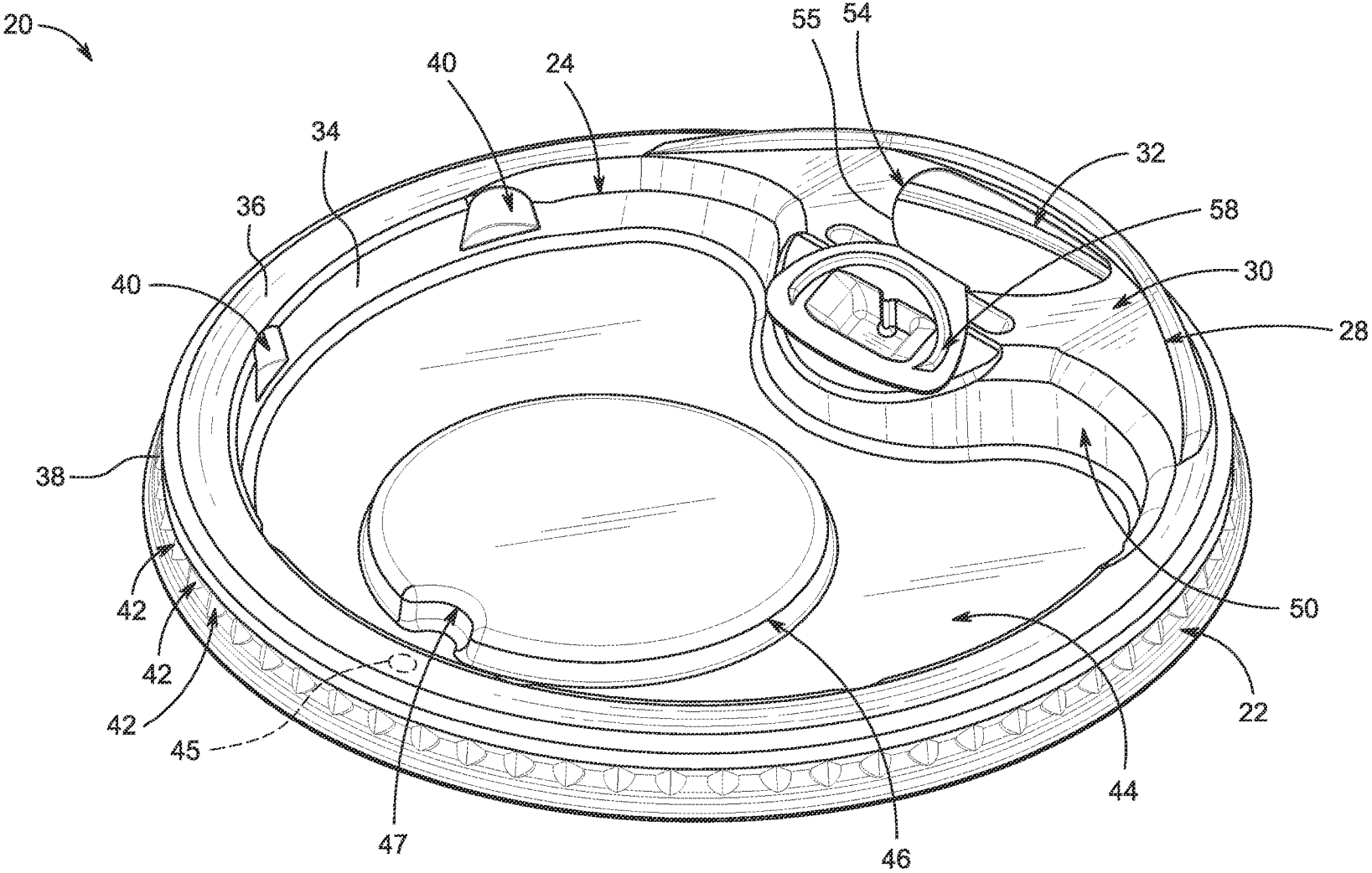
FIG. 5 is an enlarged perspective view of the lid with the outlet closure in the opened position.
Figure 8:
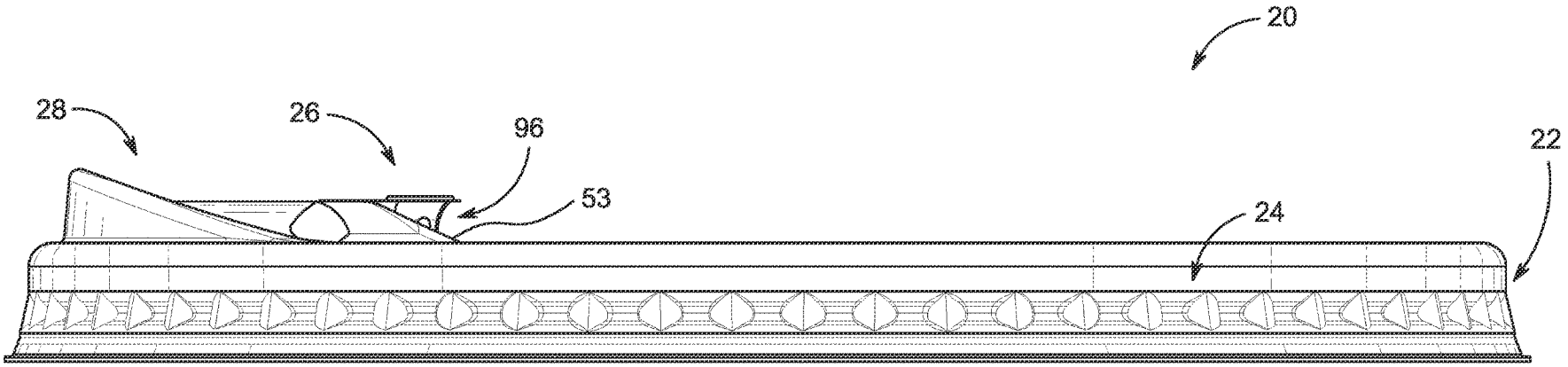
FIG. 8 is a side elevation view of the lid with the outlet closure in the opened position showing the outlet-closure skirt spaced apart from the outlet-closure retainer so that a user fit their finger between the outlet-closure skirt and the outlet-closure retainer to disengage the outlet closure from the outlet-closure retainer and return the outlet closure to the closed position.

Outlet closure 26 is movable about a horizontal pivot axis 48 between a closed position blocking access to the liquid-discharge outlet 32, as shown in FIGS. 1-3, and an opened position spaced apart from liquid-discharge outlet 32 as shown in FIGS. 5 and 8. Drink Spout 28 further includes a side wall 50 and an outlet-closure retainer 52 configured to retain outlet closure 26 in the opened position. Side wall 50 extends downwardly from top wall 30 and is coupled to central basin 44. Outlet-closure retainer 52 is illustratively embodied as a cavity that is formed into a reclined surface 53 of side wall 50. Outlet-closure retainer 52 has a shape that receives at least a portion of outlet closure 26 in the opened position to retain the outlet closure 26 in the opened position with an interface fit.

Outlet closure 26 includes an outlet-closure skirt 54, an outlet-closure pedestal 56 that extends upwardly from outlet-closure skirt 54, and an outlet-closure reinforcement rib 58 coupled to the outlet-closure skirt 54 as shown in FIGS. 2 and 3. The outlet-closure skirt 54 has an outer edge with a shape that matches a perimeter of the liquid-discharge outlet 32. The outer edge of outlet-closure skirt 54 and the perimeter of liquid-discharge outlet 32 may be initially coupled to one another to provide a break line 55. Break line 55 may be provided by a series of perforations, scoring, or another suitable method in top wall 30 which allows outlet-closure skirt 54 to be at least partially separated from top wall 30 along break line 55. Outlet-closure pedestal 56 is formed in a generally central region of outlet-closure skirt 54 and is configured to be engaged by a consumer to change outlet closure 26 from the closed position to the opened position for access to liquids in interior liquid reservoir chamber 15. Outlet-closure reinforcement rib 58 increases a rigidity of outlet closure 26 so that outlet closure 26 pivots relative to top wall 30 about horizontal pivot axis 48 to facilitate changing outlet closure 26 from the closed position to the opened position.

Outlet-closure reinforcement rib 58 is formed as an indentation into an outer surface of outlet-closure skirt 54 and has an arcuate shape to extend at least partially around outlet-closure pedestal 56 as shown in FIG. 3. Outlet-closure reinforcement rib 58 has a rounded outer edge 60 that faces toward horizontal pivot axis 48 and a pair of ends 62 that are spaced further away from horizontal pivot axis 48 than rounded outer edge 60. Break line 55 terminates in a groove 57 formed in top wall 30 to establish horizontal pivot axis 48 in groove 57. Groove 57 is spaced apart from outlet-closure reinforcement rib 58 to locate outlet-closure reinforcement rib 58 between outlet-closure pedestal 56 and groove 57. Outlet-closure reinforcement rib 58 directs forces toward horizontal pivot axis 48 and blocks outlet closure 26 from folding along a line somewhere between outlet-closure pedestal 56 and horizontal pivot axis 48 so that outlet closure 26 is aligned with outlet-closure retainer 52 when outlet closure 26 reaches the opened position.

Outlet-closure retainer 52 has a shape that corresponds to at least a portion of outlet-closure pedestal 56 as shown in FIG. 5. Outlet-closure retainer 52 is defined by a forward surface 64, a rear surface 66, first and second lateral surfaces 68, 70 and a bottom surface 72. Forward surface 64 has a retainer protrusion 65 formed equidistant apart from each lateral surface 68, 70. The first and second lateral surfaces 68, 70 provide guide surfaces for outlet-closure pedestal 56 to facilitate a consumer in inserting outlet-closure pedestal into outlet-closure retainer 52. The first and second lateral surfaces each include an angled upper portion 74 that extend toward one another and a vertically extending lower portion 76 arranged parallel to one another. Outlet-closure retainer 52 has a width between each angled upper portion 74 that is greater than a corresponding portion of outlet-closure pedestal 56. The width of outlet-closure retainer 52 may be slightly less than the corresponding portion of outlet-closure pedestal at lower portions 76 to provide the interface fit between outlet-closure retainer 52 and outlet-closure pedestal 56.

Outlet-closure pedestal 56 includes a curved surface 78 that faces outwardly away from a center of lid 20, a first side surface 80, an opposite second side surface 82, and a retainer surface 84 that faces toward the center of lid 20 as shown in FIG. 3. Curved surface 78 provides an ergonomic finger pad for a consumer to use to lift and change outlet closure 26 from the closed position to the opened position. First side surface 80, second side surface 82, and retainer surface 84 each include a vertically extending portion 86 spaced apart from outlet-closure skirt 54 and a broadening portion 88 that extends downward and outward away from each companion vertically extending portion 86 and is coupled to outlet-closure skirt 54. Each broadening portion 88 contacts outlet-closure reinforcement rib 58 to form a portion of outlet-closure reinforcement rib 58. Retainer surface 84 is also formed to include an indentation 85 that receives retainer protrusion 65 when outlet-closure pedestal 56 is inserted in outlet-closure retainer 52 in the closed position.

Figure 6:
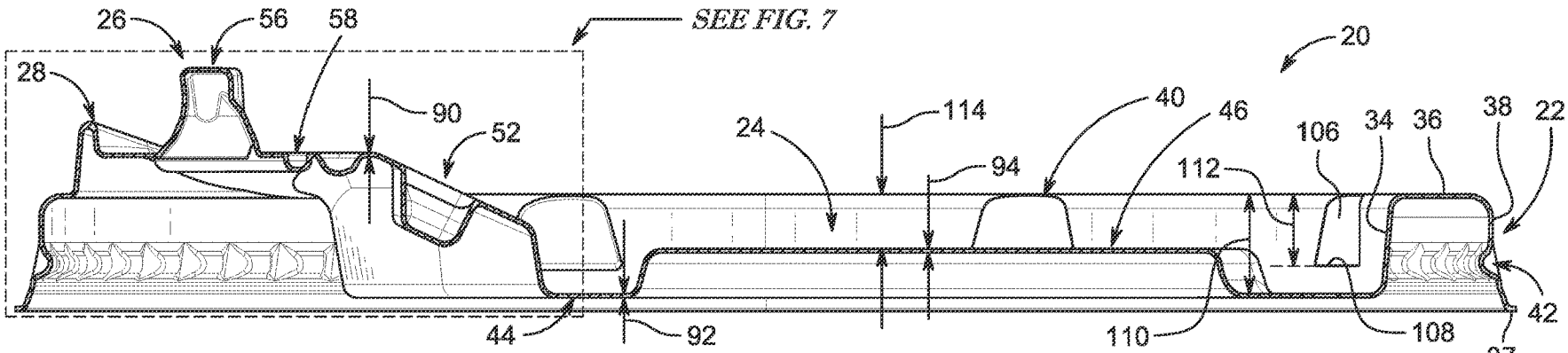
FIG. 6 is a sectional view of the lid taken along line 6-6 in FIG. 2 to show that the lid is made from a sheet with a thickness that varies between several different locations of the lid.

Lid 20 is made from a sheet of polymeric material that includes polypropylene. In some embodiments, the sheet consists of polypropylene, however, the sheet may include other polymeric materials such as, for example, polystyrene, polyethylene, or any other suitable polymeric material. The sheet is formed into lid 20 using a thermoforming process in illustrative embodiments, however, any other suitable forming process may also be used. Lid 20 is shaped to have a low profile such that substantially all of the features of lid 20 are arranged between top wall 36 of brim mount 22 and a lower edge 37 of brim mount as shown in FIGS. 6 and 7. Only drink spout 28 extends above top wall 36 so as to minimize the amount of material required to form lid 20.

A thickness of the sheet may be minimized to reduce the overall weight of lid 20 as shown in FIG. 6. Minimizing the thickness of the sheet may cause areas of lid 20 to be flexible, however, flexibility in certain areas such as outlet closure 26, for example, may not be desired. Accordingly, outlet-closure reinforcement rib 58 is provided on outlet closure 26 to rigidify outlet closure 26 to facilitate movement of outlet closure 26 about horizontal pivot axis 48 between the closed and opened positions.

The sheet forming lid 20 may have a first thickness 90 at drink spout 28, a second thickness 92 at central basin 44, and a third thickness 94 at plateau 46. In some embodiments, second thickness 92 is less than both first thickness 90 and third thickness 94. In some embodiments, the third thickness 94 is less than or equal to the first thickness 90 and greater than the second thickness 92.

The following Examples of lids 20 are non-limiting. All of the values shown below for Examples 1 to 3 are approximate and may have a manufacturing tolerance within plus or minus 20 percent.

EXAMPLE 1

The first example of a lid 20 with varying thicknesses 90, 92, 94 is described below in Table 1. This lid 20 is made from polypropylene and has an outer diameter of about 4.25 inches.

TABLE 1

| Gram Weight | Thickness 90 | Thickness 92 | Thickness 94 | Weight/Diameter Ratio |
|---|---|---|---|---|
| 2.96 g | 0.015 in | 0.012 in | 0.014 in | 0.7 |

EXAMPLE 2

The second example of a lid 20 with varying thicknesses 90, 92, 94 is described below in Table 2. This lid 20 is made from polypropylene and has an outer diameter of about 3.97 inches.

TABLE 2

| Gram Weight | Thickness 90 | Thickness 92 | Thickness 94 | Weight/Diameter Ratio |
|---|---|---|---|---|
| 2.77 g | 0.014 in | 0.011 in | 0.014 in | 0.7 |

EXAMPLE 3

The third example of a lid 20 with varying thicknesses 90, 92, 94 is described below in Table 3. This lid 20 is made from polypropylene and has an outer diameter of about 3.64 inches.

TABLE 3

| Gram Weight | Thickness 90 | Thickness 92 | Thickness 94 | Weight/Diameter Ratio |
|---|---|---|---|---|
| 2.04 g | 0.013 in | 0.010 in | 0.013 in | 0.56 |

Accordingly, lid 20 may have a weight-to-diameter ratio of less than 1 due to the low profile design of lid 20, the thicknesses 90, 92, 94, and the material used to form lid 20. In some embodiments, the weight-to-diameter ratio is within a range of about 0.5 to about 0.8. In some embodiments, the weight-to-diameter ratio is within a range of about 0.55 to about 0.8. In some embodiments, the weight-to-diameter ratio is within a range of about 0.6 to about 0.8. In some embodiments, the weight-to-diameter ratio is within a range of about 0.65 to about 0.8. In some embodiments, the weight-to-diameter ratio is within a range of about 0.7 to about 0.8. In some embodiments, the weight-to-diameter ratio is within a range of about 0.75 to about 0.8. In some embodiments, the weight-to-diameter ratio is within a range of about 0.5 to about 0.75. In some embodiments, the weight-to-diameter ratio is within a range of about 0.5 to about 0.7. In some embodiments, the weight-to-diameter ratio is within a range of about 0.5 to about 0.65. In some embodiments, the weight-to-diameter ratio is within a range of about 0.5 to about 0.6. In some embodiments, the weight-to-diameter ratio is within a range of about 0.5 to about 0.55. In some embodiments, the weight-to-diameter ratio is within a range of about 0.55 to about 0.75. In some embodiments, the weight-to-diameter ratio is within a range of about 0.68 to about 0.7. In some embodiments, the weight-to-diameter ratio is within a range of about 0.69 to about 0.8. In some embodiments, the weight-to-diameter ratio is within a range of about 0.57 to about 0.6.

EXAMPLE 4

The fourth example of a comparable lid that is different than lid 20 of the illustrative embodiment is described below in Table 4. This lid is made from polyethylene terephthalate and has an outer diameter of about 3.97 inches. The lid also has varying thicknesses 90, 92, however, the lid does not have a plateau 46 so thickness 94 is not applicable.

TABLE 4

| Gram Weight | Thickness 90 | Thickness 92 | Thickness 94 | Weight/Diameter Ratio |
|---|---|---|---|---|
| 3.82 g | 0.015 in | 0.011 in | N/A | 0.96 |

Referring back to lid 20 of the illustrative embodiment, top wall 30 of drink spout 28 is arranged to lie on a horizontal plane 59 as shown in FIG. 7. Reclined surface 53 is arranged to lie on a retainer plane 61 which extends away from top wall 30 at an angle 63 relative to horizontal plane 59. In one embodiment, angle 63 is within a range of about 5 degrees to about 80 degrees. In one embodiment, angle 63 is within a range of about 10 degrees to about 80 degrees. In one embodiment, angle 63 is within a range of about 15 degrees to about 80 degrees. In one embodiment, angle 63 is within a range of about 20 degrees to about 80 degrees. In one embodiment, angle 63 is within a range of about 25 degrees to about 80 degrees. In one embodiment, angle 63 is within a range of about 30 degrees to about 80 degrees. In one embodiment, angle 63 is within a range of about 35 degrees to about 80 degrees. In one embodiment, angle 63 is within a range of about 40 degrees to about 80 degrees. In one embodiment, angle 63 is within a range of about 45 degrees to about 80 degrees. In one embodiment, angle 63 is within a range of about 50 degrees to about 80 degrees. In one embodiment, angle 63 is within a range of about 55 degrees to about 80 degrees. In one embodiment, angle 63 is within a range of about 60 degrees to about 80 degrees. In one embodiment, angle 63 is within a range of about 65 degrees to about 80 degrees. In one embodiment, angle 63 is within a range of about 70 degrees to about 80 degrees. In one embodiment, angle 63 is within a range of about 75 degrees to about 80 degrees. In one embodiment, angle 63 is within a range of about 5 degrees to about 75 degrees. In one embodiment, angle 63 is within a range of about 5 degrees to about 70 degrees. In one embodiment, angle 63 is within a range of about 5 degrees to about 65 degrees. In one embodiment, angle 63 is within a range of about 5 degrees to about 60 degrees. In one embodiment, angle 63 is within a range of about 5 degrees to about 55 degrees. In one embodiment, angle 63 is within a range of about 5 degrees to about 50 degrees. In one embodiment, angle 63 is within a range of about 5 degrees to about 45 degrees. In one embodiment, angle 63 is within a range of about 5 degrees to about 40 degrees. In one embodiment, angle 63 is within a range of about 5 degrees to about 35 degrees. In one embodiment, angle 63 is within a range of about 5 degrees to about 30 degrees. In one embodiment, angle 63 is within a range of about 5 degrees to about 25 degrees. In one embodiment, angle 63 is within a range of about 5 degrees to about 20 degrees. In one embodiment, angle 63 is within a range of about 5 degrees to about 15 degrees. In one embodiment, angle 63 is within a range of about 5 degrees to about 10 degrees. In another example, angle 63 is within a range of about 10 degrees to about 60 degrees. In another example, angle 63 is within a range of about 20 degrees to about 50 degrees. In another example, angle 63 is within a range of about 20 degrees to about 30 degrees, In another example, angle 63 is about 25 degrees.

Forward surface 64 is arranged to extend substantially in a vertical direction perpendicular to horizontal plane 59 as shown in FIG. 7. Rear surface 66 is arranged to lie at an angle to forward surface 64 to provide clearance for outlet-closure pedestal 56 to extend into outlet-closure retainer 52 as outlet closure 26 rotated about horizontal pivot axis 48 from the closed position to the opened position. In the opened position, outlet-closure skirt 54 remains substantially parallel to horizontal plane 59 to provide a gap 96 between outlet-closure skirt 54 and reclined surface 53 so that the consumer can fit a finger there between to remove outlet-closure pedestal from outlet-closure retainer and return outlet closure to the closed position as shown in FIG. 8.

Lid 20 may include plateau 46 for any of a variety of reasons. Plateau 46 may include, for example, a company logo or indicia and/or a slotted straw opening. Plateau 46 may include an orientation indentation 47 at or near a rear portion of plateau 46 for any of a variety of reasons, including but not limited to helping a user locate the rear part of lid 20, for example by locating and/or feeling orientation indentation 47 with a finger without actually looking at lid 20. Orientation indentation 47 may be formed in a side wall of orientation indentation 47, which may extend upwardly from central basin 44. By locating orientation indentation 47, a user may be better able to locate liquid-discharge outlet 32 and/or outlet closure 26, for example, and better prevent spilling when attempting to drink through lid 20. Lid 20 may also be formed to include a vent aperture 45 in central basin 44, which may for example be located at or near plateau 46 and/or orientation indentation 47 as show in FIG. 2. Vent aperture 45 may be included for any of a variety of reasons, or not at all.

Inner side wall 34 is formed to include a series of indents 40 spaced circumferentially apart from one another about a central axis 20A of drink cup lid 20 as shown in FIGS. 1 and 2. The series of indents 40 are each formed at least partially into top wall 36 of ring-shaped brim mount 22. Top wall 36 has a first radial width 100 at each of the indents 40 and a second radial width 102, greater than the first radial width 100, circumferentially between each of the indents 40. Each of the indents 40 is at least partially defined by a curved sidewall 106 to provide top wall 36 with a third radial width 104, greater than the first radial width 100 and less than the second radial width 102, at a location circumferentially between the first radial width 100 and the second radial width 102.

Each of the indents 40 may include a curved sidewall 106 and a bottom wall 108 that extends substantially perpendicular to the curved sidewall as shown in FIG. 2. Curved sidewall 106 is concave relative to central axis 20A of drink cup lid 20. Curved sidewall 106 of each indent 40 has a center 40C located radially between inner side wall 34 of ring-shaped brim mount 22 and central axis 20A of drink cup lid 20. Closure basin 44 is spaced apart from top wall 36 of ring-shaped brim mount 22 by a first distance 110, and bottom wall 108 of each indent 40 is spaced apart from top wall 36 of ring-shaped brim mount 22 by a second distance 112 less than the first distance 110. Closure basin 44 includes a lower top wall spaced apart from top wall 36 of ring-shaped brim mount 22 by the first distance 110 and a plateau 46 coupled to the lower top wall and having a plateau top wall that is spaced apart vertically from top wall 36 of ring-shaped brim mount 22 by a third distance 114 that is less than the first distance 110 and the second distance 112.

Figure 13:
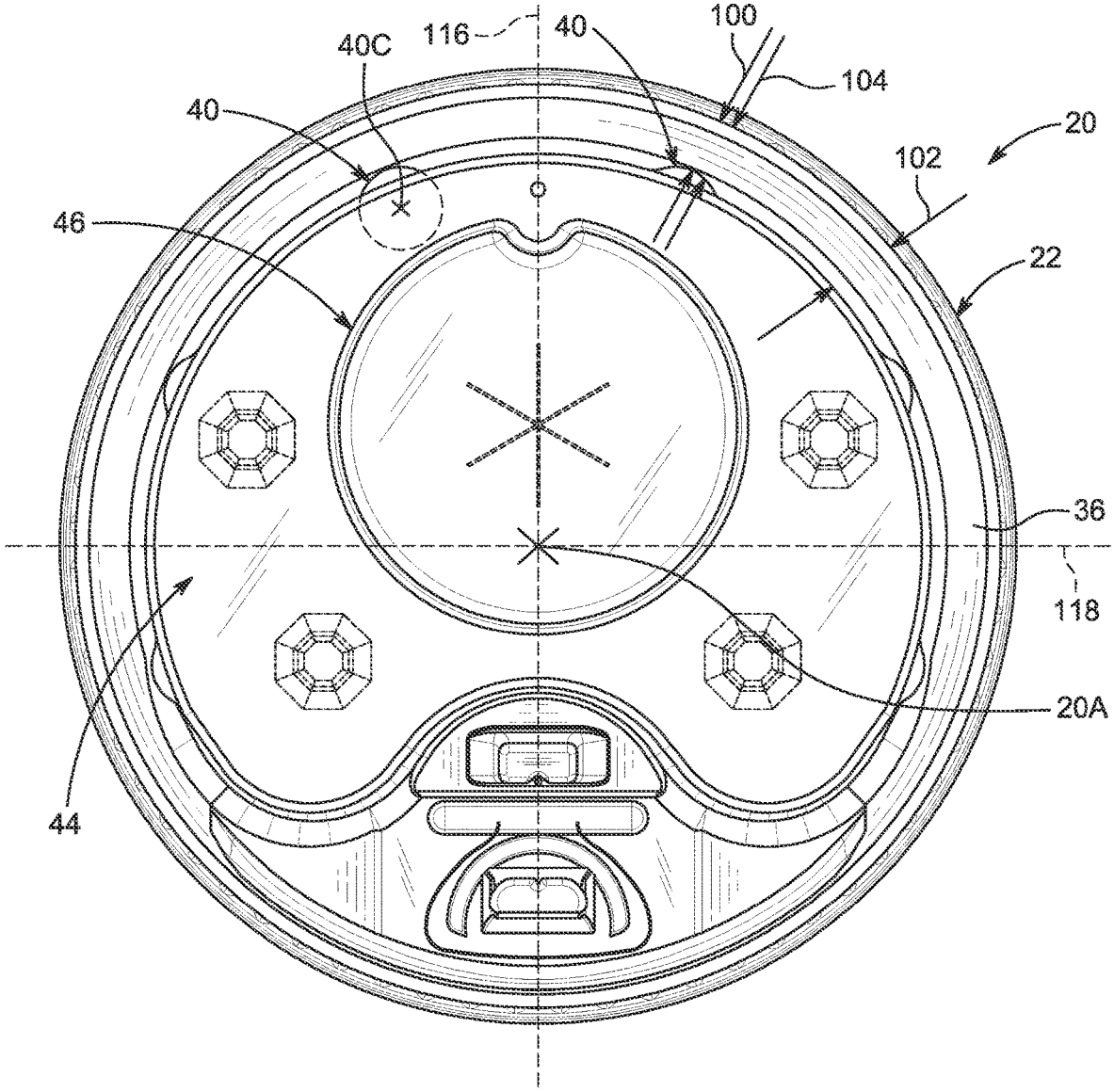
FIG. 13 is a perspective view of a sixth embodiment of a lid in accordance with the present disclosure.
Figure 14:
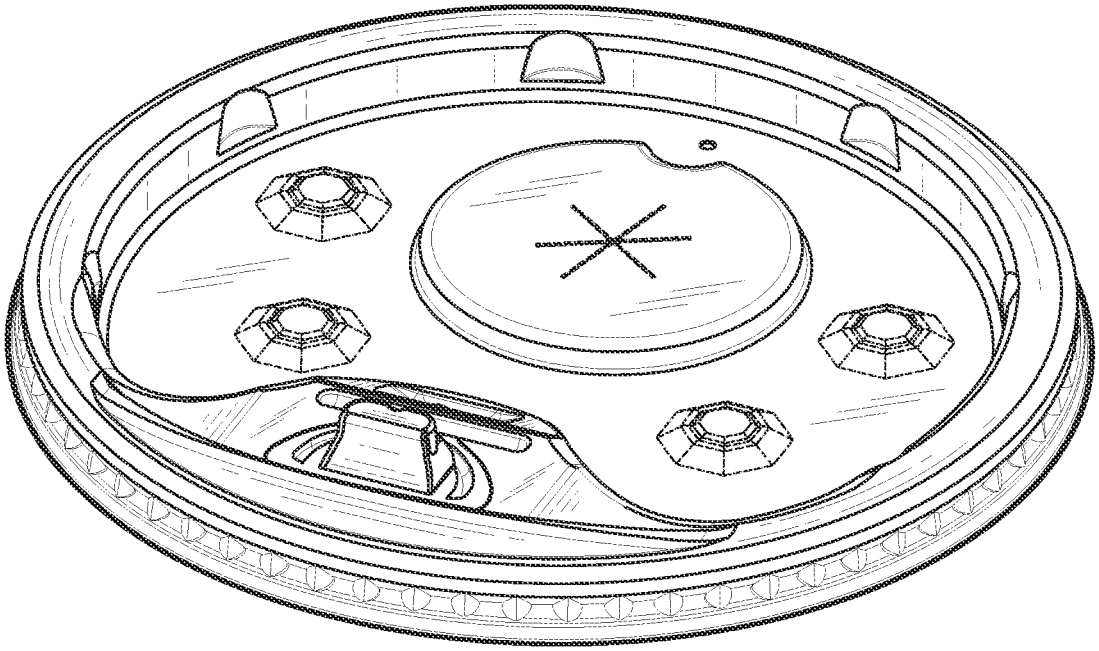
FIG. 14 is a top perspective view of the sixth embodiment of the lid.
Figure 15:
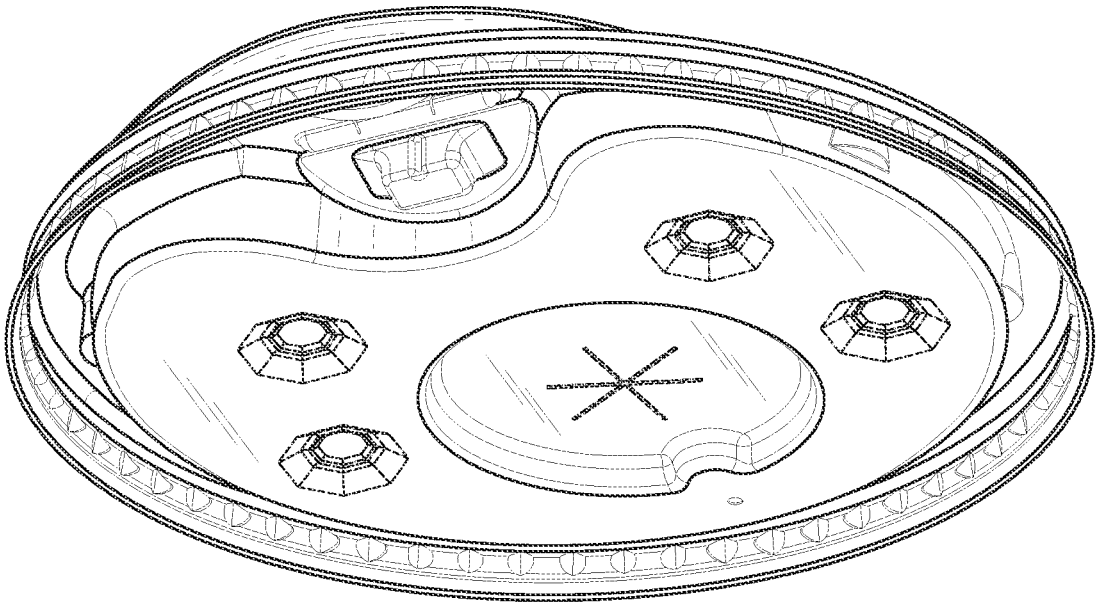
FIG. 15 is a bottom perspective view of the sixth embodiment of the lid
Figure 16:
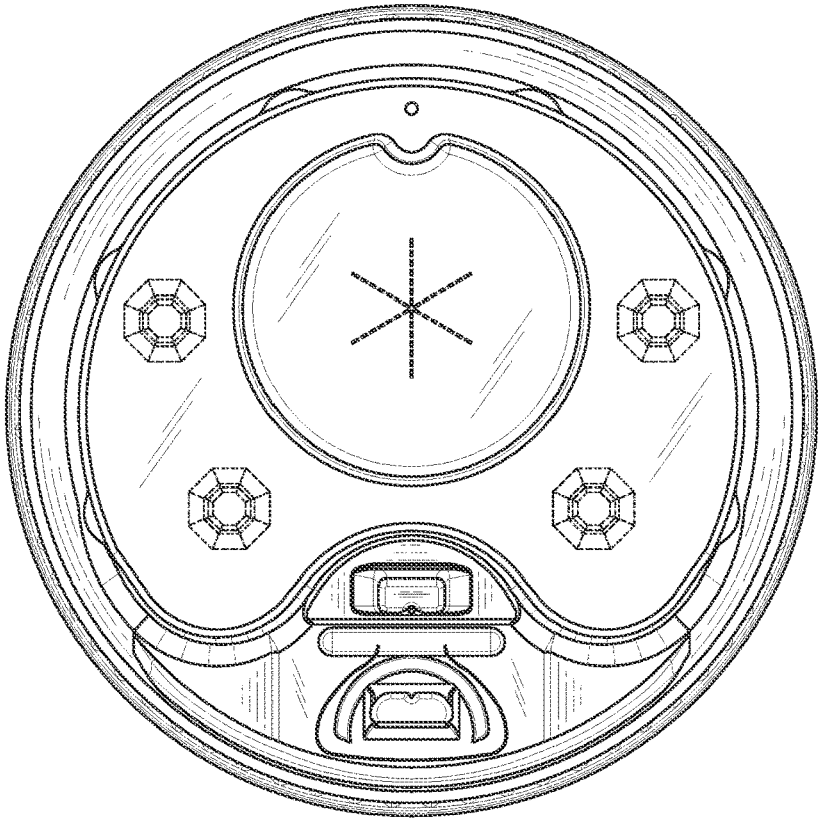
FIG. 16 is a top plan view of a sixth embodiment of the lid.
Figure 17:
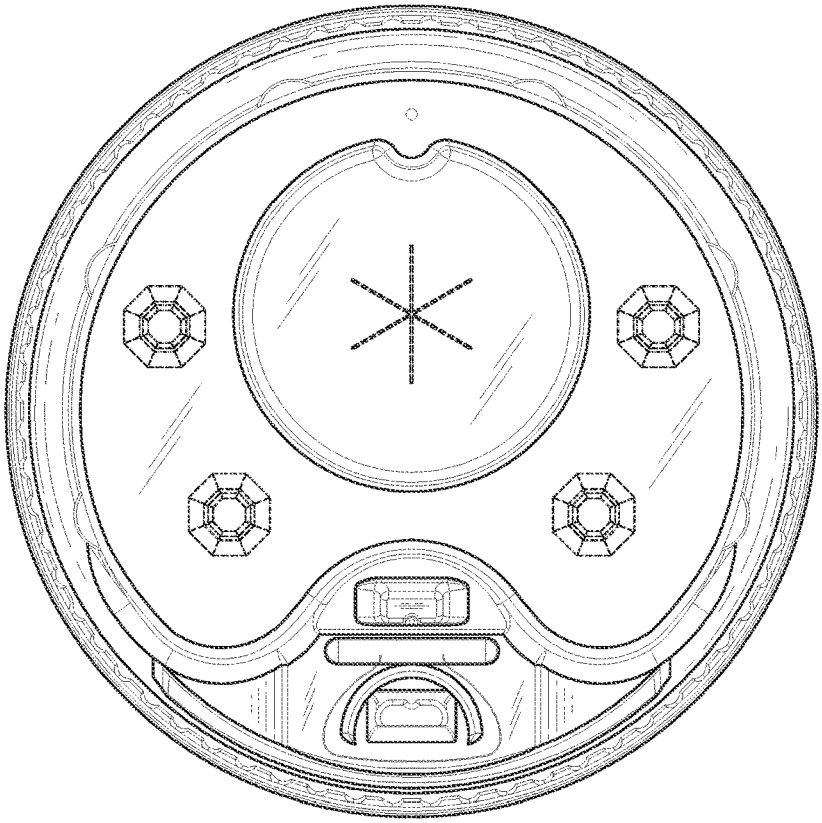
FIG. 17 is a bottom plan view of the sixth embodiment of the lid.
Figure 18:
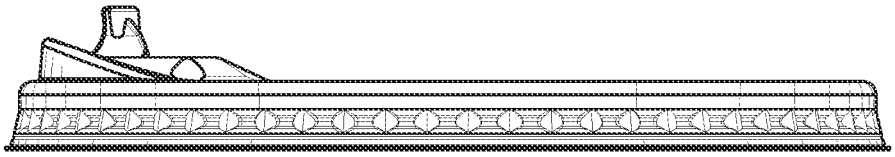
FIG. 18 is a side elevation view of the sixth embodiment of the lid.
Figure 19:
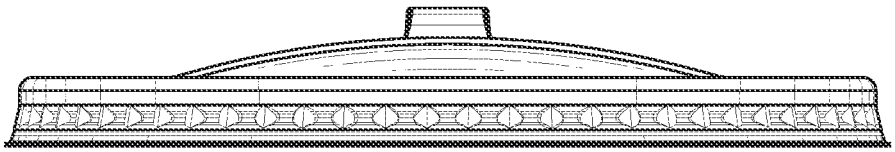
FIG. 19 is a rear elevation view of the sixth embodiment of the lid.
Figure 20:
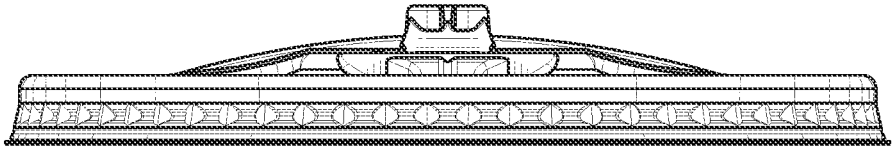
FIG. 20 is a front elevation view of the sixth embodiment of the lid.
Figure 21:
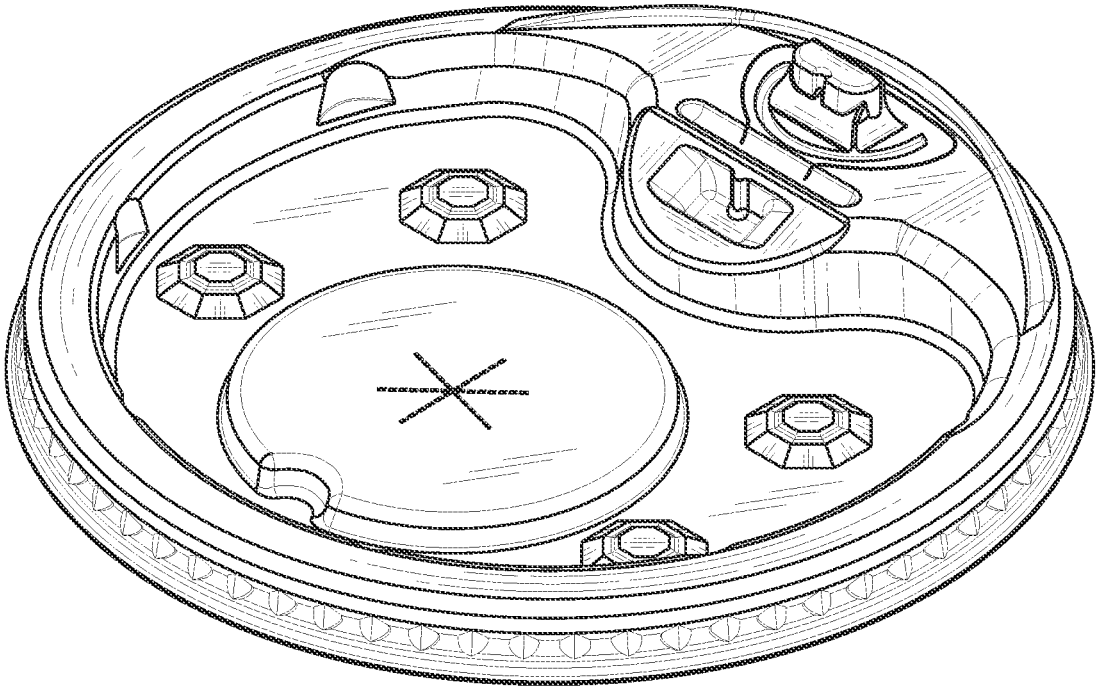
FIG. 21 is a perspective view of a seventh embodiment of a lid in accordance with the present disclosure.
Figure 22:
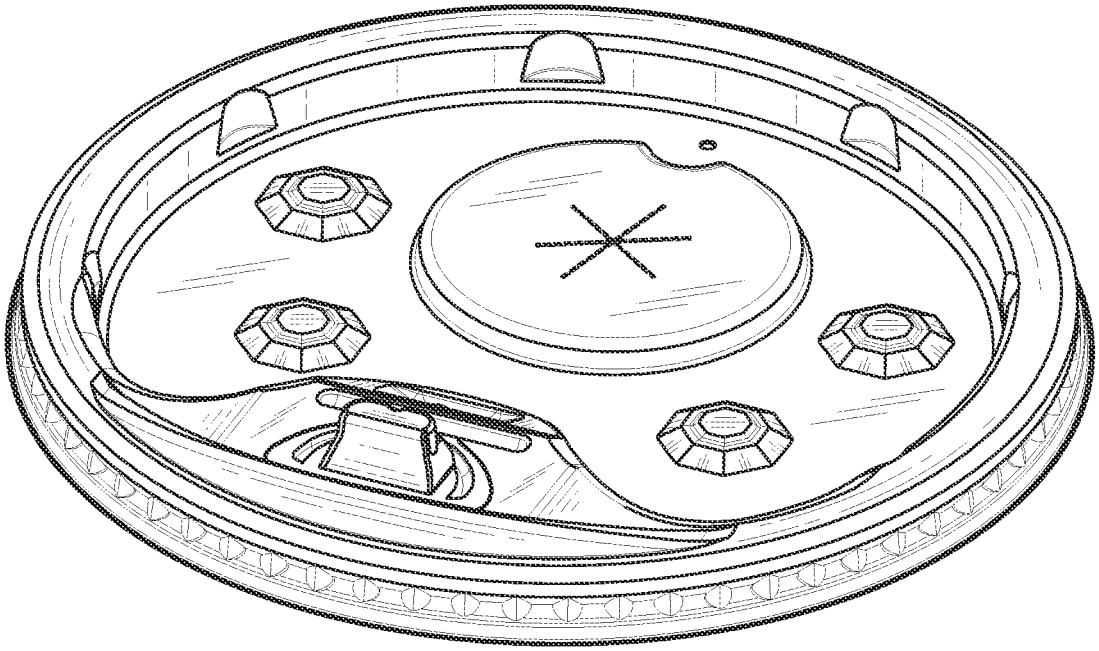
FIG. 22 is a top perspective view of the seventh embodiment of the lid.
Figure 23:
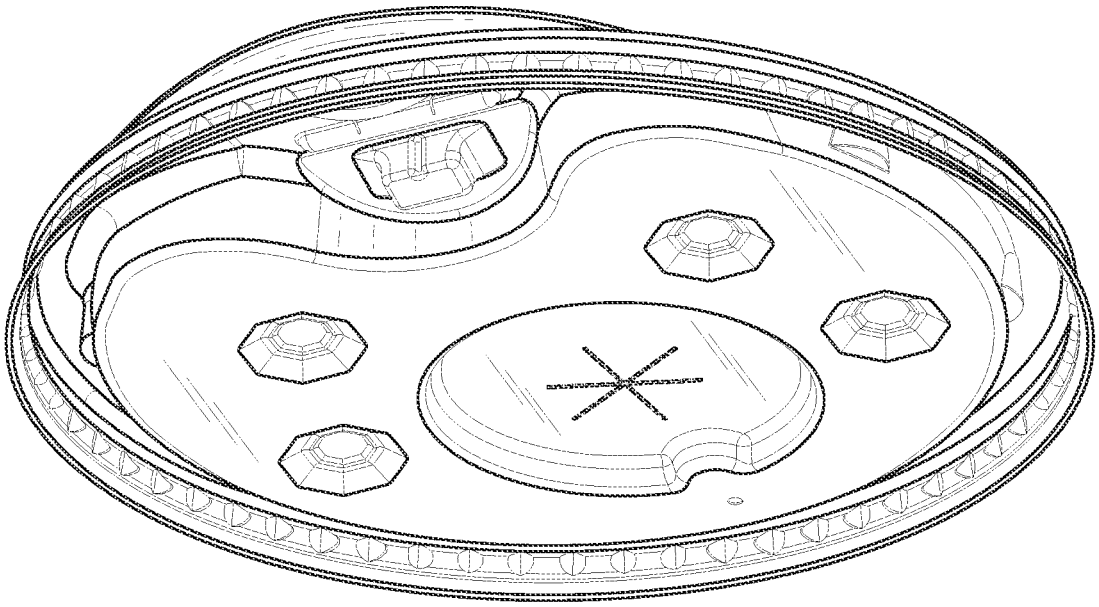
FIG. 23 is a bottom perspective view of the seventh embodiment of the lid
Figure 24:
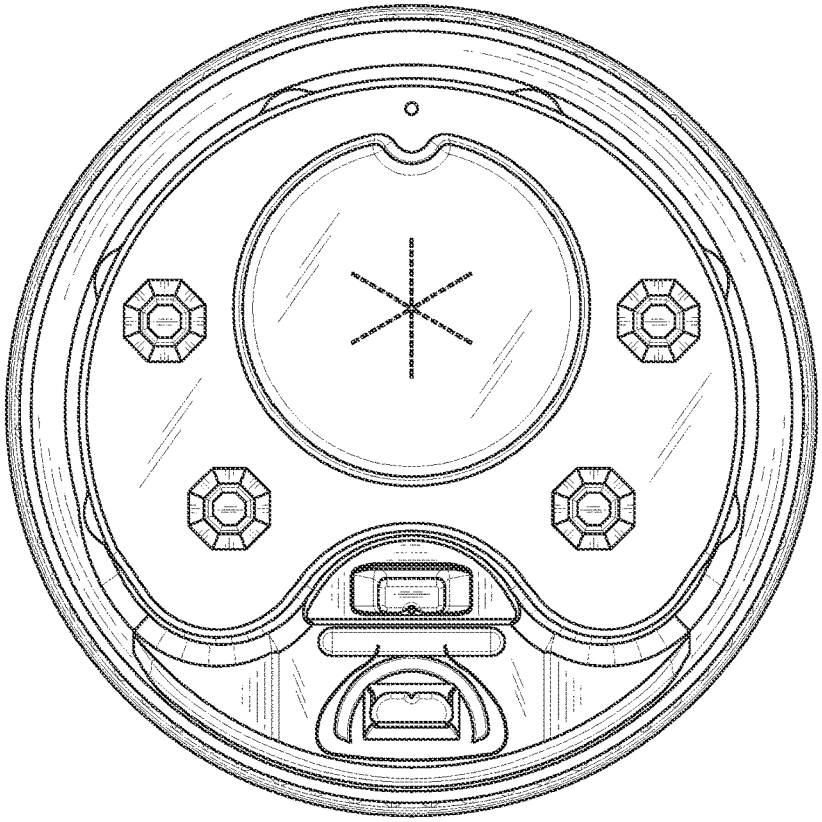
FIG. 24 is a top plan view of the seventh embodiment of the lid.
Figure 25:
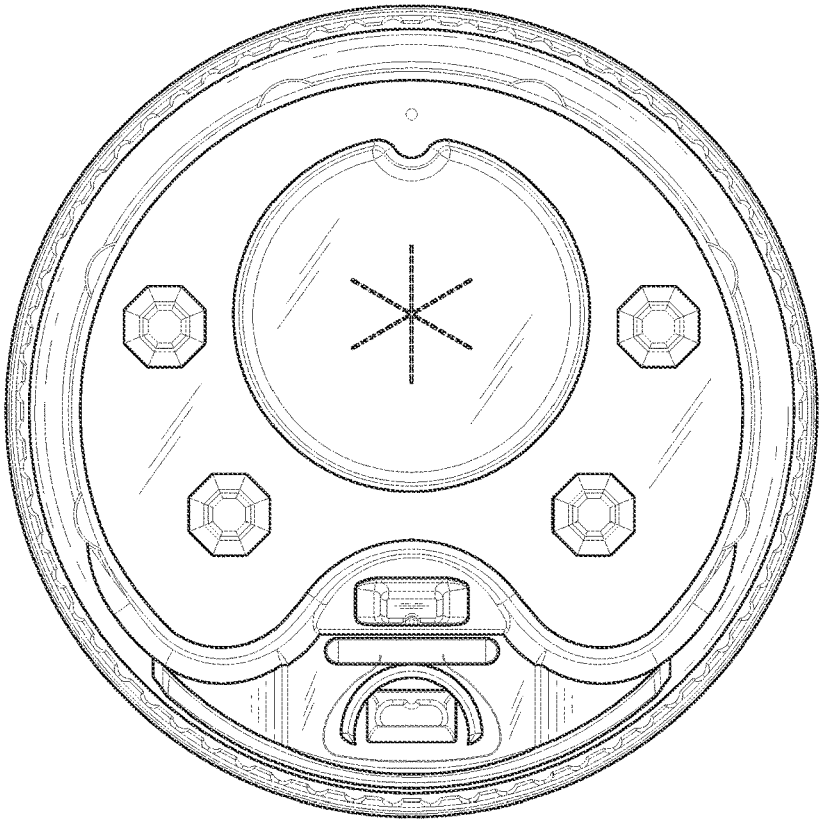
FIG. 25 is a bottom plan view of the seventh embodiment of the lid.
Figure 26:
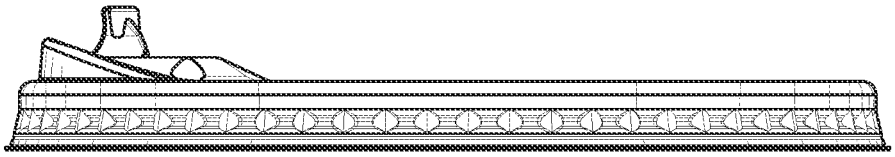
FIG. 26 is a side elevation view of the seventh embodiment of the lid.
Figure 27:
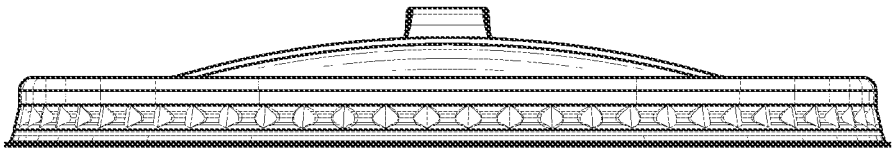
FIG. 27 is a rear elevation view of the seventh embodiment of the lid.
Figure 28:
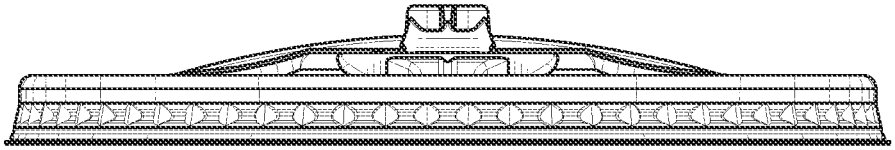
FIG. 28 is a front elevation view of the seventh embodiment of the lid.
Figure 29:
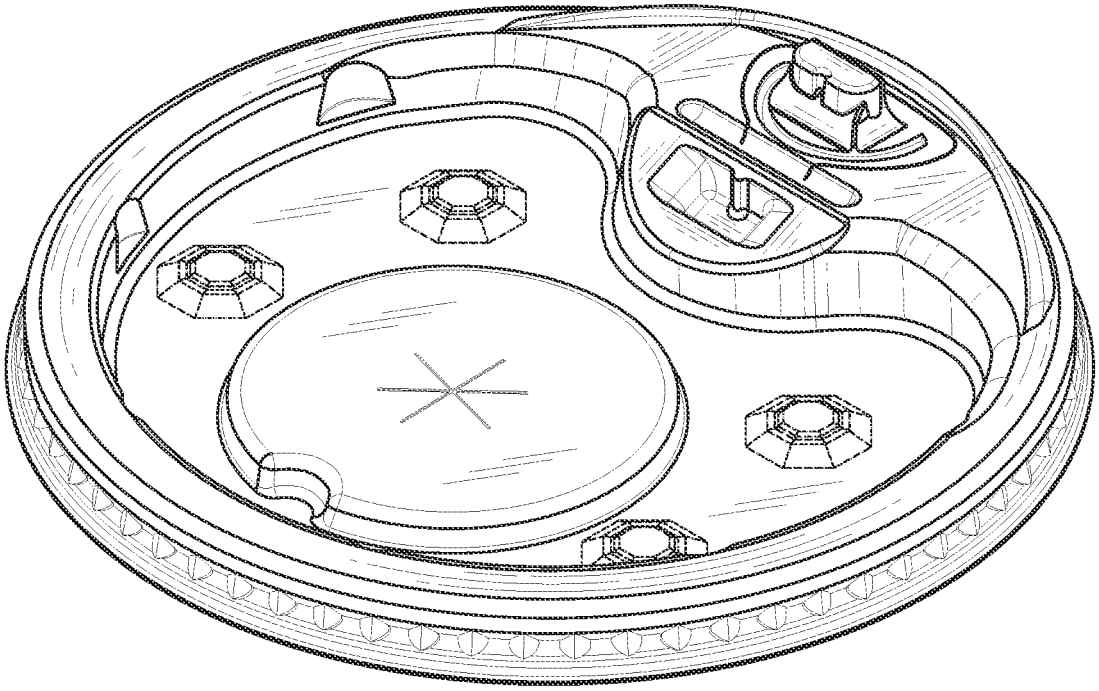
FIG. 29 is a perspective view of an eighth embodiment of a lid in accordance with the present disclosure.
Figure 30:
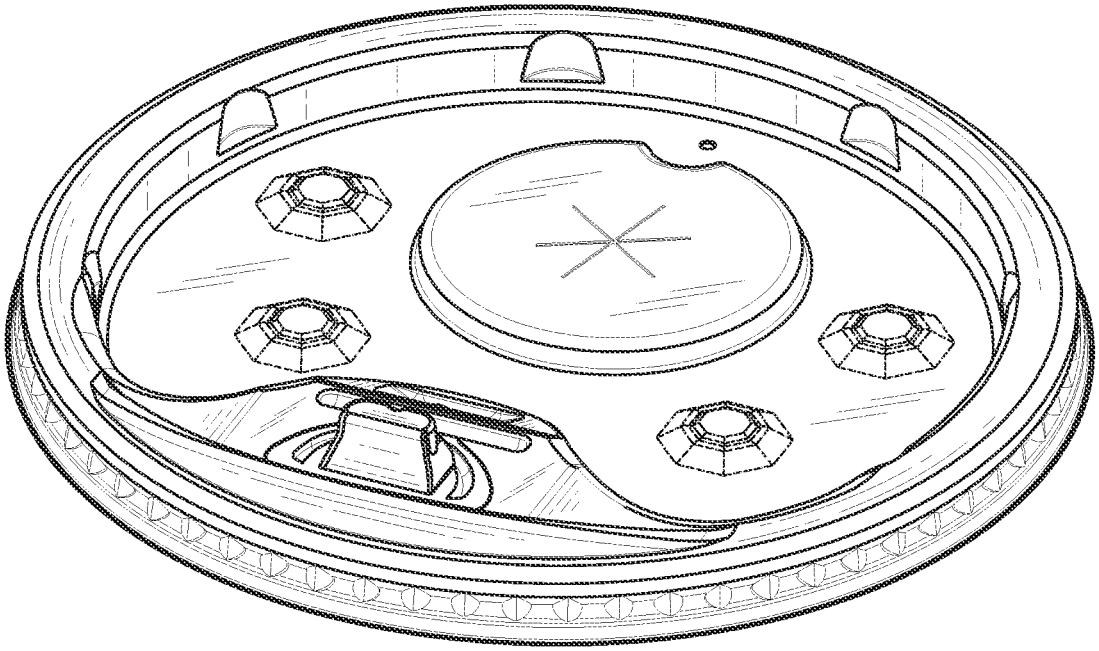
FIG. 30 is a top perspective view of the eighth embodiment of the lid.
Figure 31:
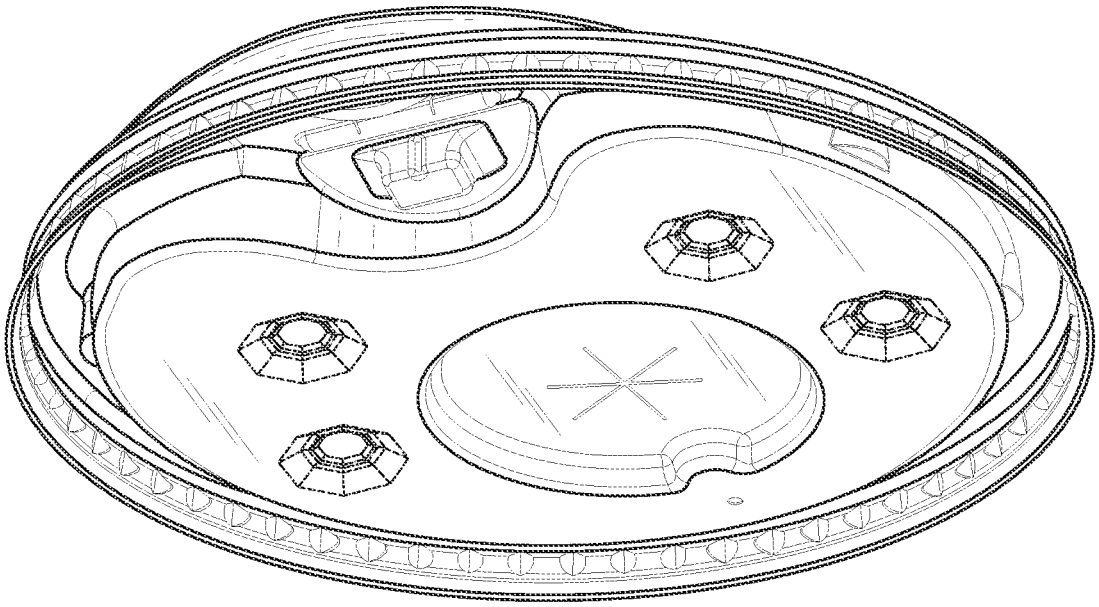
FIG. 31 is a bottom perspective view of the eighth embodiment of the lid
Figure 32:
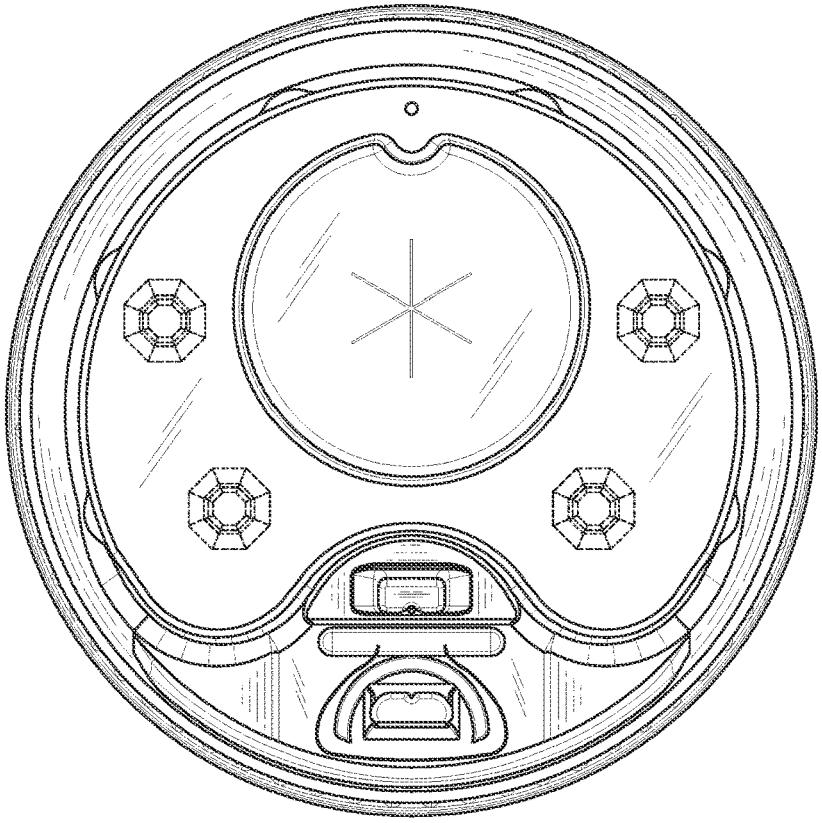
FIG. 32 is a top plan view of the eighth embodiment of the lid.
Figure 33:
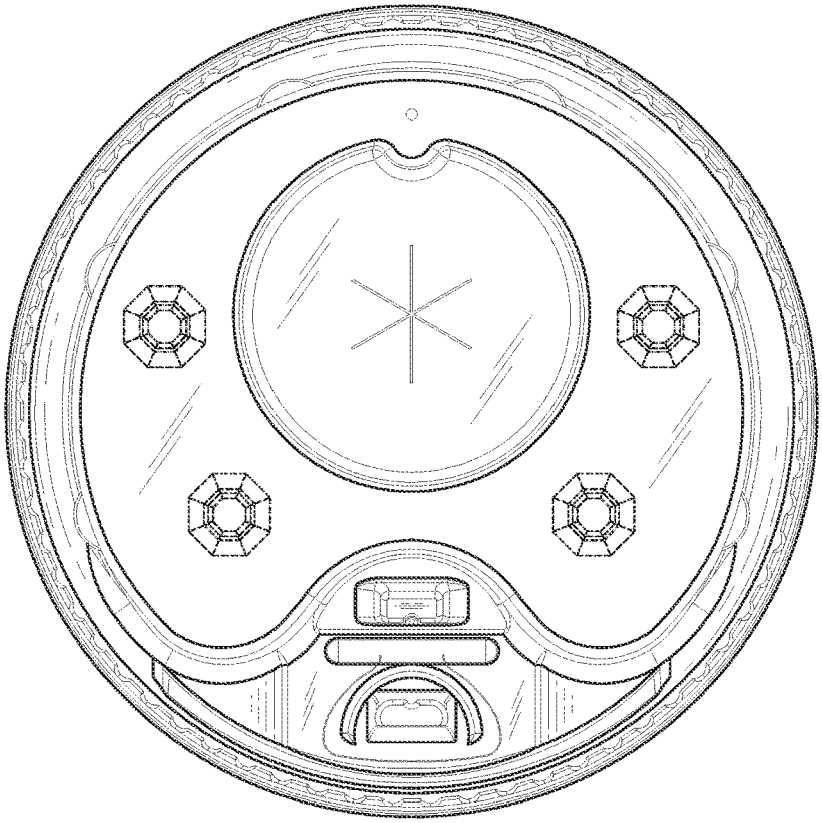
FIG. 33 is a bottom plan view of the eighth embodiment of the lid.
Figure 34:
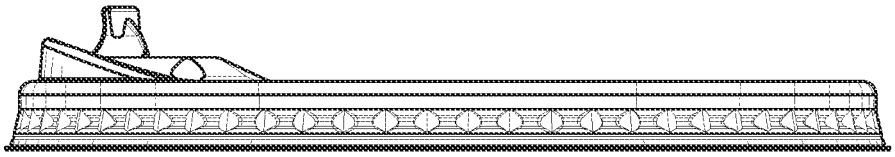
FIG. 34 is a side elevation view of the eighth embodiment of the lid.
Figure 35:
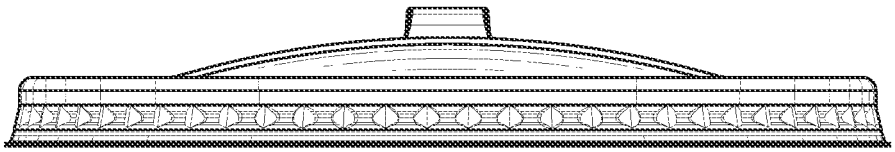
FIG. 35 is a rear elevation view of the eighth embodiment of the lid.
Figure 36:
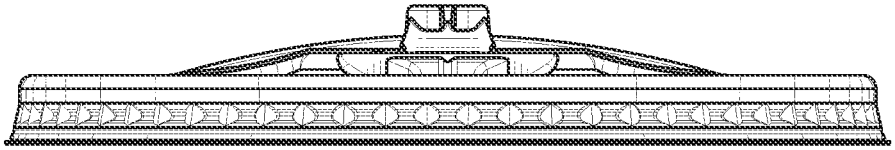
FIG. 36 is a front elevation view of the eighth embodiment of the lid.
Figure 37:
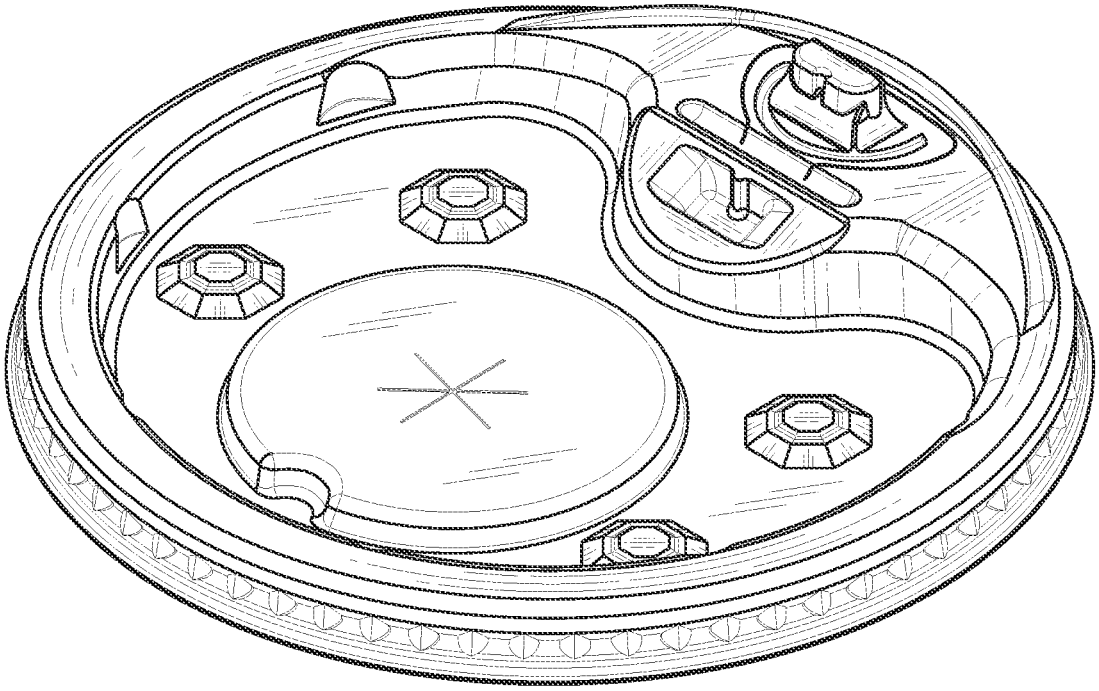
FIG. 37 is a perspective view of a ninth embodiment of a lid in accordance with the present disclosure.
Figure 38:
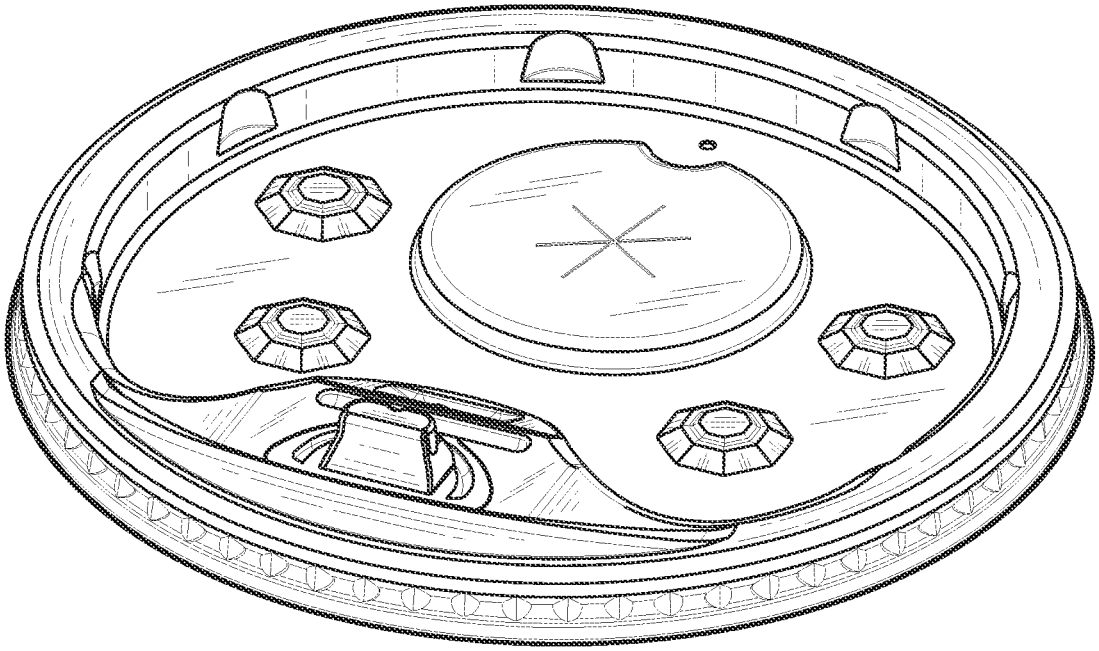
FIG. 38 is a top perspective view of the ninth embodiment of the lid.
Figure 39:
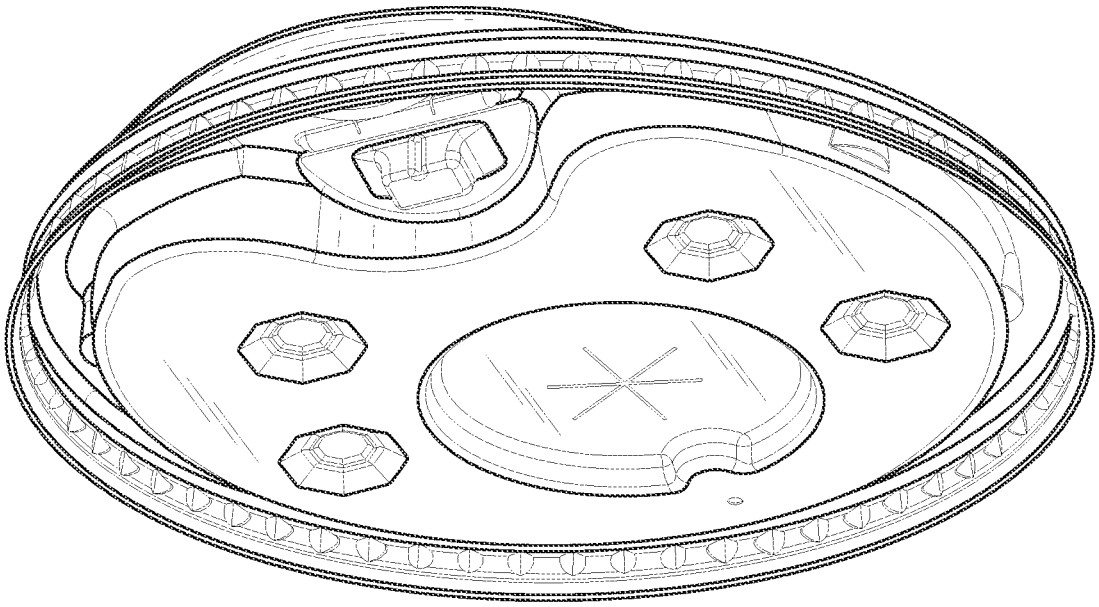
FIG. 39 is a bottom perspective view of the ninth embodiment of the lid
Figure 40:
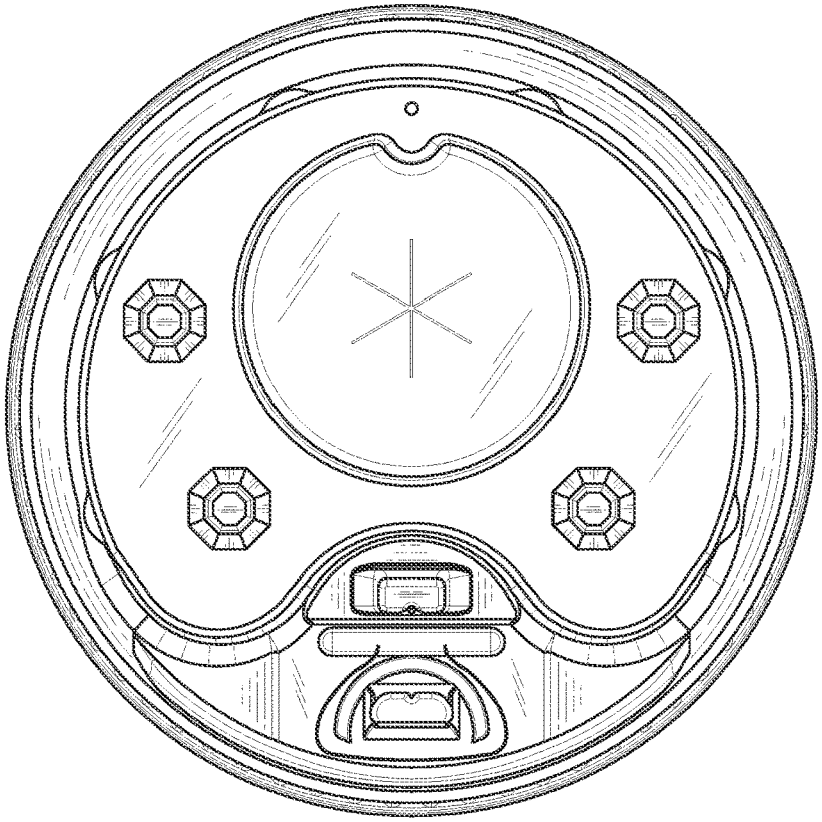
FIG. 40 is a top plan view of the ninth embodiment of the lid.
Figure 41:
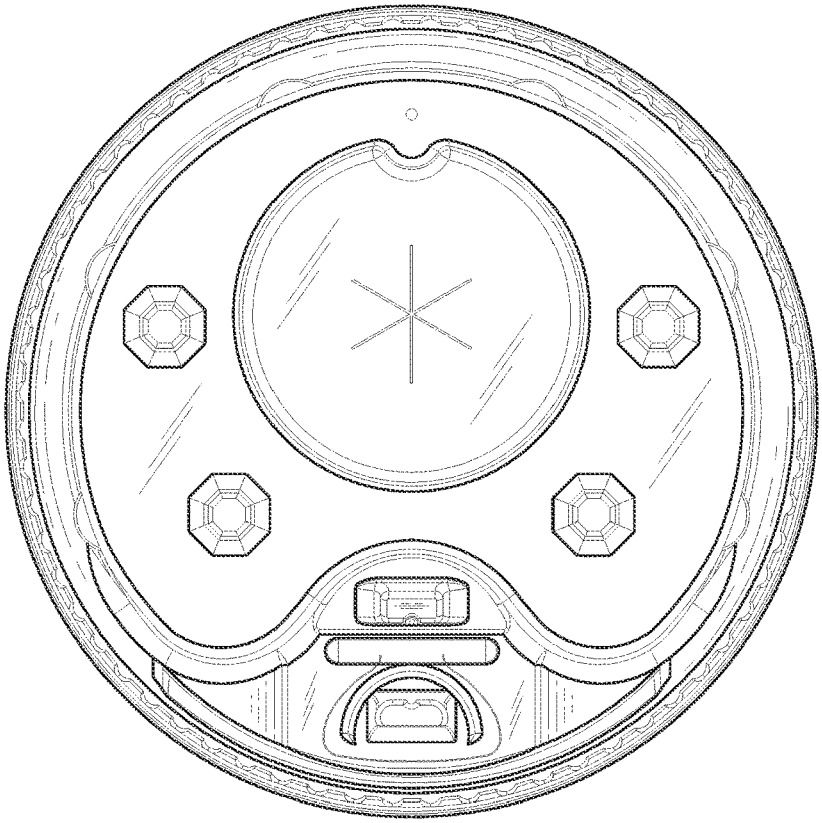
FIG. 41 is a bottom plan view of the ninth embodiment of the lid.
Figure 42:
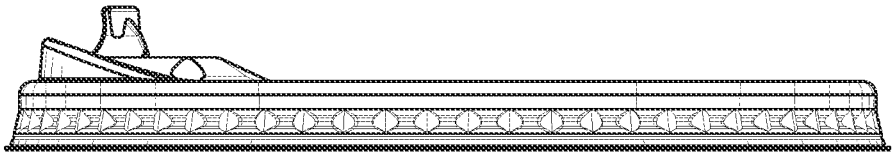
FIG. 42 is a side elevation view of the ninth embodiment of the lid.
Figure 43:
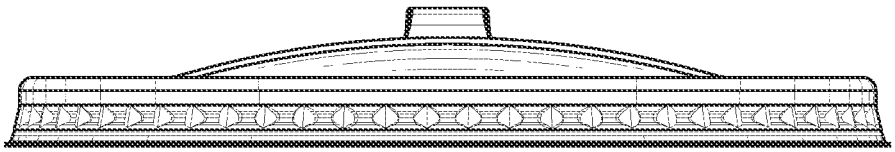
FIG. 43 is a rear elevation view of the ninth embodiment of the lid.
Figure 44:
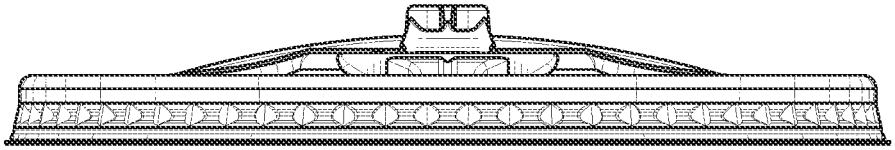
FIG. 44 is a front elevation view of the ninth embodiment of the lid.
Figure 45:
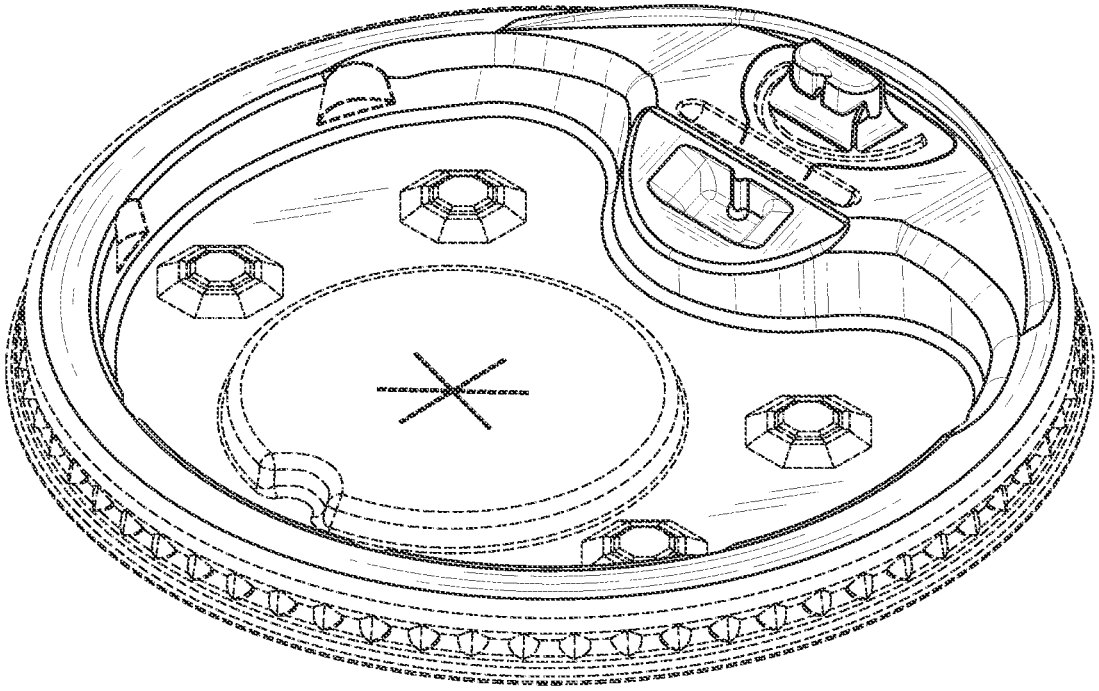
FIG. 45 is a perspective view of a tenth embodiment of a lid in accordance with the present disclosure.
Figure 46:
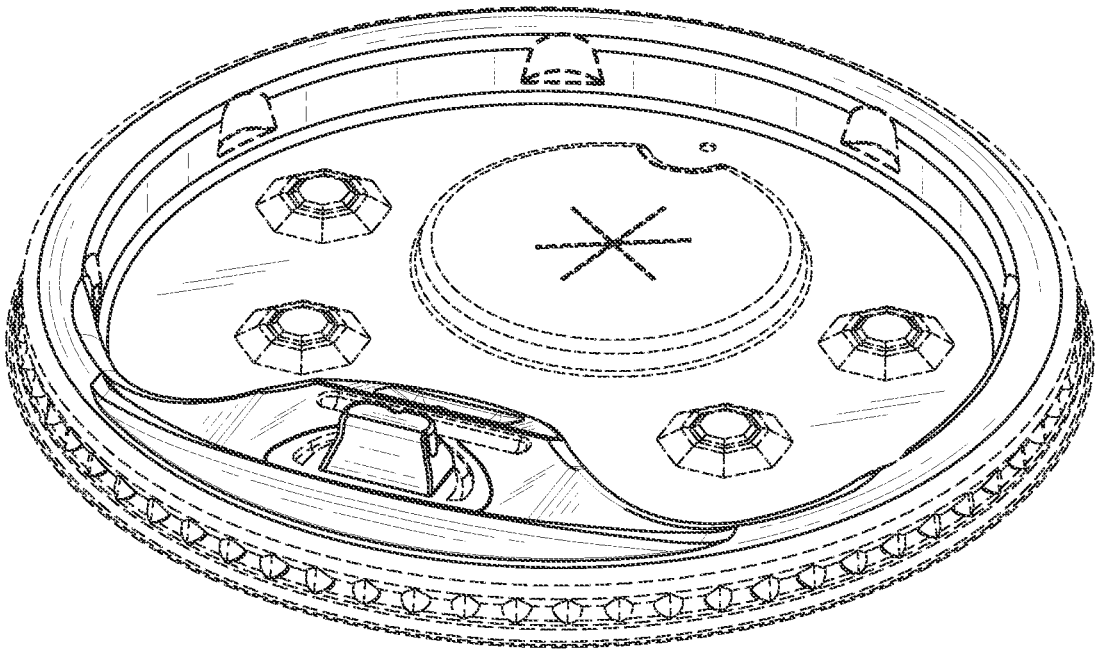
FIG. 46 is a top perspective view of the tenth embodiment of the lid.
Figure 47:
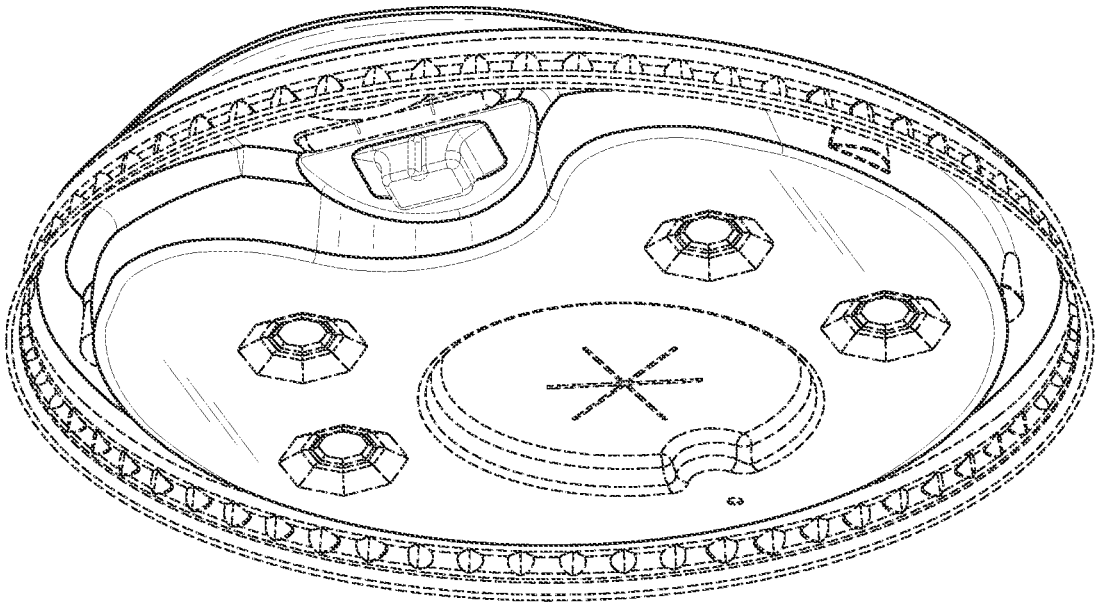
FIG. 47 is a bottom perspective view of the tenth embodiment of the lid
Figure 48:
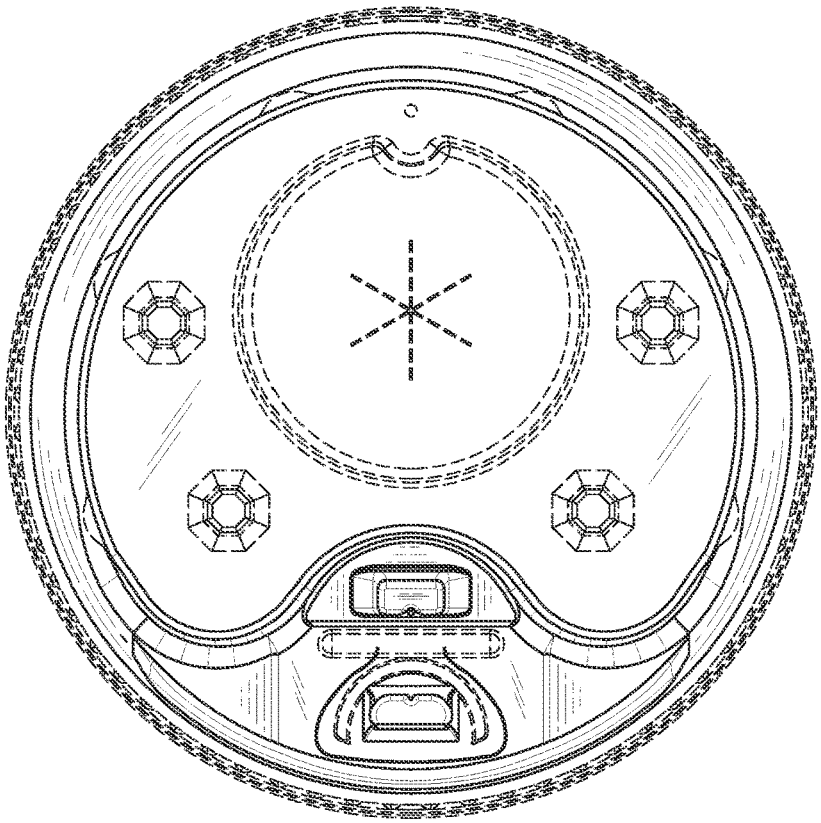
FIG. 48 is a top plan view of the tenth embodiment of the lid.
Figure 49:
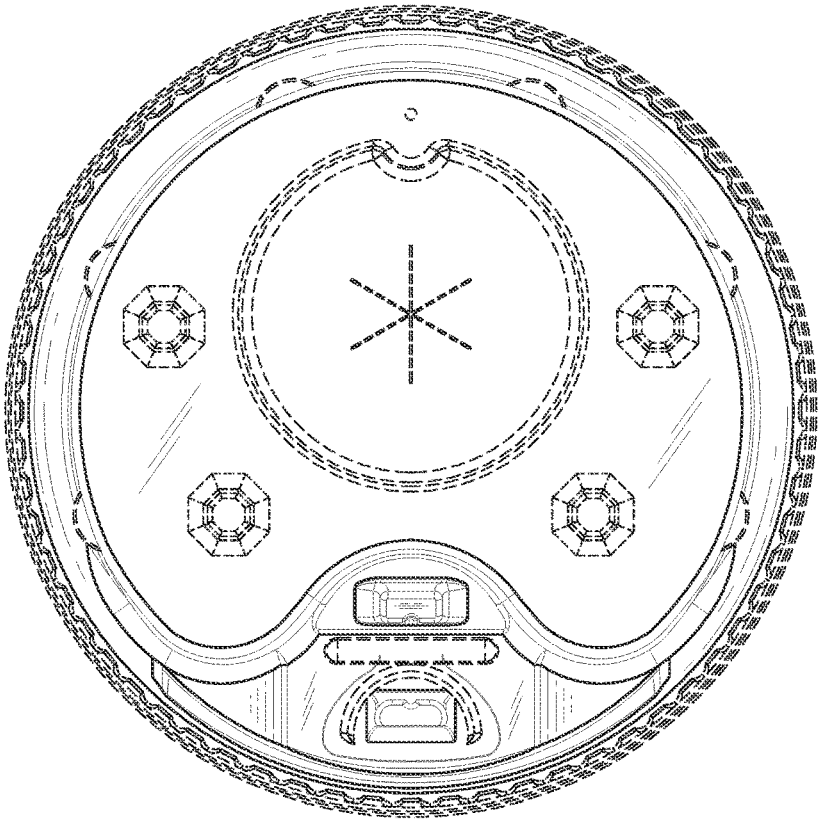
FIG. 49 is a bottom plan view of the tenth embodiment of the lid.
Figure 50:
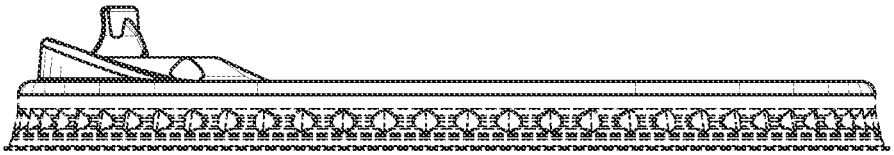
FIG. 50 is a side elevation view of the tenth embodiment of the lid.
Figure 51:
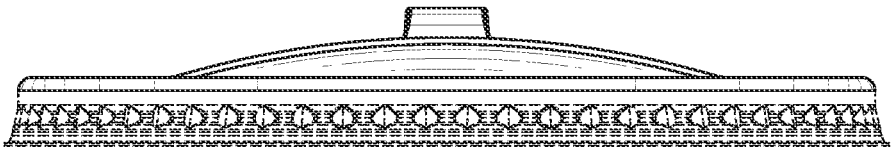
FIG. 51 is a rear elevation view of the tenth embodiment of the lid.
Figure 52:
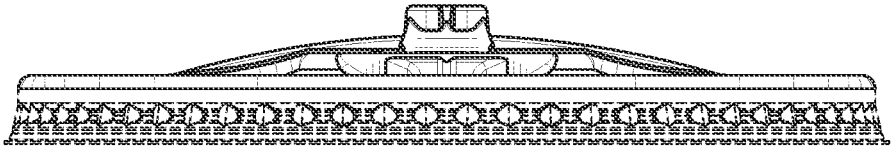
FIG. 52 is a front elevation view of the tenth embodiment of the lid.

The series of indents 40 are arranged symmetrically about a first plane 116 extending through the central axis 20A and the outlet closure 26 as shown in FIG. 13. The series of indents 40 are arranged unsymmetrically about a second plane 118 extending perpendicular to the first plane 116.

Another embodiment of a lid 220 in accordance with the present disclosure is shown in FIG. 9. Lid 220 is substantially similar to lid 20. Accordingly, reference numbers in the 200 series are used to reference common features between lid 220 and lid 20. The disclosure of lid 20 is hereby incorporated by reference for lid 220 while the differences between lid 220 and lid 20 are described below.

Lid 220 includes a ring-shaped brim mount 222, a central closure 224, and an outlet closure 226 as shown in FIG. 9. Brim mount 222 cooperates with brim 14 to provide a sealing interface to block flow of liquids between brim 14 and lid 220 when lid 220 is mounted on cup 12. Central closure 224 of lid 220 rises upwardly above brim mount 222 in illustrative embodiments and includes an upstanding drink spout 228 including a top wall 230 formed to include a liquid-discharge outlet 232. Outlet closure 226 is sized and arranged to cover liquid-discharge outlet 232 until a consumer desires to remove liquid from the interior liquid reservoir chamber 15.

Ring-shaped brim mount 222 includes an inner side wall 234, a top wall 236, and an outer side wall 238 as shown in FIG. 9. Central closure 224 is coupled to inner side wall 234 of brim mount 222 and forms an upper barrier to block liquids from flowing out of interior liquid reservoir chamber 15 until outlet closure 226 is removed from liquid-discharge outlet 232. Central closure 224 includes drink spout 228, a central basin 244, and a plateau 246 as shown in FIG. 9. Drink spout 228 is coupled to central basin 244 and extends upwardly to a raised elevation above top wall 236 of brim mount 222. Drink spout 228 is the only structure of lid 220 that raises above top wall 236 to provide lid 220 with a low profile to minimize an overall weight of lid 220 as will be described in greater detail herein. Central basin 244 is coupled to inner side wall 234 of brim mount 222 and is arranged below top wall 236. Plateau 246 extends upwardly from central basin 244 and is also arranged to lie below top wall 236 of brim mount 222. A straw opening 297 is formed in a top wall of plateau 246. Central basin 244 is formed to include a vent aperture 245. Accordingly, lid 220 may be used for drinking a liquid from cup 12 by through liquid-discharge outlet 232 or with a straw (not shown) inserted in straw opening 297.

Another embodiment of a lid 320 in accordance with the present disclosure is shown in FIG. 10. Lid 320 is substantially similar to lid 20. Accordingly, reference numbers in the 300 series are used to reference common features between lid 320 and lid 20. The disclosure of lid 20 is hereby incorporated by reference for lid 320 while the differences between lid 320 and lid 20 are described below.

Lid 320 includes a ring-shaped brim mount 322, a central closure 324, and an outlet closure 326 as shown in FIG. 10. Brim mount 322 cooperates with brim 14 to provide a sealing interface to block flow of liquids between brim 14 and lid 320 when lid 320 is mounted on cup 12. Central closure 324 of lid 320 rises upwardly above brim mount 322 in illustrative embodiments and includes an upstanding drink spout 328 including a top wall 330 formed to include a liquid-discharge outlet 332. Outlet closure 326 is sized and arranged to cover liquid-discharge outlet 332 until a consumer desires to remove liquid from the interior liquid reservoir chamber 15.

Ring-shaped brim mount 322 includes an inner side wall 334, a top wall 336, and an outer side wall 338 as shown in FIG. 10. Central closure 324 is coupled to inner side wall 334 of brim mount 322 and forms an upper barrier to block liquids from flowing out of interior liquid reservoir chamber 15 until outlet closure 326 is removed from liquid-discharge outlet 332. Central closure 324 includes drink spout 328, a central basin 344, and a plateau 346 as shown in FIG. 10. Drink spout 328 is coupled to central basin 344 and extends upwardly to a raised elevation above top wall 336 of brim mount 322. Drink spout 328 is the only structure of lid 320 that raises above top wall 336 to provide lid 320 with a low profile to minimize an overall weight of lid 320 as will be described in greater detail herein. Central basin 344 is coupled to inner side wall 334 of brim mount 322 and is arranged below top wall 336. Plateau 346 extends upwardly from central basin 344 and is also arranged to lie below top wall 336 of brim mount 322.

Central basin 344 includes a plurality of push buttons 398 that extend upwardly in the same direction as plateau 346. The plurality of push buttons 398 provide a mechanism for a user to provide an input to at least one of the buttons so that the button will change from a first condition to a second condition. For example, a user may push a button 398 so that it is no longer upwardly projecting but rather changes to a downwardly projecting state that a user can readily visually or tactilely identify. Such a feature could be used to indicate the contents of a cup to which the lid is coupled. Central basin 344 may also include other indicia near each button 398 that could be used also to provide information to a user in any of a variety of ways. Indicia and push buttons 398 could cooperate to communicate information to a user, such as a button 398 proximate a certain indicia being used to suggest that indicia.

Another embodiment of a lid 420 in accordance with the present disclosure is shown in FIG. 11. Lid 420 is substantially similar to lid 20. Accordingly, reference numbers in the 400 series are used to reference common features between lid 420 and lid 20. The disclosure of lid 20 is hereby incorporated by reference for lid 420 while the differences between lid 420 and lid 20 are described below.

Lid 420 includes a ring-shaped brim mount 422, a central closure 424, and an outlet closure 426 as shown in FIG. 11. Brim mount 422 cooperates with brim 14 to provide a sealing interface to block flow of liquids between brim 14 and lid 420 when lid 420 is mounted on cup 12. Central closure 424 of lid 420 rises upwardly above brim mount 422 in illustrative embodiments and includes an upstanding drink spout 428 including a top wall 430 formed to include a liquid-discharge outlet 432. Outlet closure 426 is sized and arranged to cover liquid-discharge outlet 432 until a consumer desires to remove liquid from the interior liquid reservoir chamber 15.

Ring-shaped brim mount 422 includes an inner side wall 434, a top wall 436, and an outer side wall 438 as shown in FIG. 11. Central closure 424 is coupled to inner side wall 434 of brim mount 422 and forms an upper barrier to block liquids from flowing out of interior liquid reservoir chamber 15 until outlet closure 426 is removed from liquid-discharge outlet 432. Central closure 424 includes drink spout 428, a central basin 444, and a plateau 446 as shown in FIG. 11. Drink spout 428 is coupled to central basin 444 and extends upwardly to a raised elevation above top wall 436 of brim mount 422. Drink spout 428 is the only structure of lid 420 that raises above top wall 436 to provide lid 420 with a low profile to minimize an overall weight of lid 420 as will be described in greater detail herein. Central basin 444 is coupled to inner side wall 434 of brim mount 422 and is arranged below top wall 436. Plateau 446 extends upwardly from central basin 444 and is also arranged to lie below top wall 436 of brim mount 422. A straw opening 497 is formed in a top wall of plateau 446. Central basin 444 is formed to include a vent aperture 445. Accordingly, lid 420 may be used for drinking a liquid from cup 12 through liquid-discharge outlet 432 or with a straw (not shown) inserted in straw opening 497.

Central basin 444 also includes a plurality of push buttons 498 that extend upwardly in the same direction as plateau 446. The plurality of push buttons 498 provide a mechanism for a user to provide an input to at least one of the buttons so that the button will change from a first condition to a second condition. For example, a user may push a button 498 so that it is no longer upwardly projecting but rather changes to a downwardly projecting state that a user can readily visually or tactilely identify. Such a feature could be used to indicate the contents of a cup to which the lid is coupled. Central basin 446 may also include other indicia near each button 498 that could be used also to provide information to a user in any of a variety of ways. Indicia and push buttons 498 could cooperate to communicate information to a user, such as a button 498 proximate a certain indicia being used to suggest that indicia.

Another embodiment of a lid 520 in accordance with the present disclosure is shown in FIG. 12. Lid 520 is substantially similar to lids 20 and 420. Accordingly, reference numbers in the 500 series are used to reference common features between lid 520 and lids 20 and 420. The disclosure of lids 20 and 420 is hereby incorporated by reference for lid 520 while the differences between lid 520 and lids 20, 420 are described below.

Lid 520 includes a ring-shaped brim mount 522, a central closure 524, and an outlet closure 526 as shown in FIG. 12. Brim mount 522 cooperates with brim 14 to provide a sealing interface to block flow of liquids between brim 14 and lid 520 when lid 520 is mounted on cup 12. Central closure 524 of lid 520 rises upwardly above brim mount 522 in illustrative embodiments and includes an upstanding drink spout 528 including a top wall 530 formed to include a liquid-discharge outlet 532. Outlet closure 526 is sized and arranged to cover liquid-discharge outlet 532 until a consumer desires to remove liquid from the interior liquid reservoir chamber 15.

Ring-shaped brim mount 522 includes an inner side wall 534, a top wall 536, and an outer side wall 538 as shown in FIG. 11. Central closure 524 is coupled to inner side wall 534 of brim mount 522 and forms an upper barrier to block liquids from flowing out of interior liquid reservoir chamber 15 until outlet closure 526 is removed from liquid-discharge outlet 532. Central closure 524 includes drink spout 528, a central basin 544, and a plateau 546 as shown in FIG. 12.

Drink spout 528 is coupled to central basin 544 and extends upwardly to a raised elevation above top wall 536 of brim mount 522. Drink spout 528 is the only structure of lid 520 that raises above top wall 536 to provide lid 520 with a low profile to minimize an overall weight of lid 520 as will be described in greater detail herein. Central basin 544 is coupled to inner side wall 534 of brim mount 522 and is arranged below top wall 536. Plateau 546 extends upwardly from central basin 544 and is also arranged to lie below top wall 536 of brim mount 522. A straw opening 597 is formed in a top wall of plateau 546. Central basin 544 is formed to include a vent aperture 545. Accordingly, lid 520 may be used for drinking a liquid from cup 12 through liquid-discharge outlet 532 or with a straw (not shown) inserted in straw opening 597.

Central basin 544 also includes a plurality of push buttons 598 that extend upwardly in the same direction as plateau 546. The plurality of push buttons 598 provide a mechanism for a user to provide an input to at least one of the buttons so that the button will change from a first condition to a second condition. For example, a user may push a button 598 so that it is no longer upwardly projecting but rather changes to a downwardly projecting state that a user can readily visually or tactilely identify. Such a feature could be used to indicate the contents of a cup to which the lid is coupled. Central basin 544 may also include other indicia near each button 598 that could be used also to provide information to a user in any of a variety of ways. Indicia and push buttons 598 could cooperate to communicate information to a user, such as a button 598 proximate a certain indicia being used to suggest that indicia.

Outlet closure 526 includes an outlet-closure skirt 554 and an outlet closure pedestal 556 that extends upwardly from outlet-closure skirt 554. The outlet-closure skirt 554 has an outer edge with a shape that matches a perimeter of the liquid-discharge outlet 532. Outlet closure pedestal 556 is formed in a generally central region of outlet-closure skirt 554 and is configured to be engaged by a consumer to change outlet closure 526 from the closed position to the opened position for access to liquids in interior liquid reservoir chamber 15. Outlet closure pedestal 556 includes a pedestal tip 587 and a pedestal base 589. The transition from the pedestal base 589 to the pedestal tip 587 is more abrupt than the transition from broadening portions 88 to vertically extending portions 86 of outlet-closure pedestal 56.

In some embodiments, lid 20, and/or any component thereof, may be made of any of a variety of materials, including, but not limited to, any of a variety of suitable plastics material, any other material, or any combination thereof. Suitable plastics material may include, but is not limited to, polypropylene (PP), polyethylene (PE), polyethylene terephthalate (PET), polystyrene (PS), high-density polyethylene (HDPE), low-density polyethylene (LDPE), linear low-density polyethylene (LLDPE), crystallized polyethylene terephthalate (CPET), mixtures and combinations thereof, or any other plastics material or any mixtures and combinations thereof. It is understood that multiple layers of material may be used for any of a variety of reasons, including to improve barrier properties, or to provide known functions related to multiple layer structures. The multiple layers, if included, may be of various materials, including but not limited to those recited herein.

In some embodiments, lid 20, and/or any component thereof, may be substantially rigid, substantially flexible, a hybrid of rigid and flexible, or any combination of rigid, flexible, and/or hybrid, such as having some areas be flexible and some rigid. It is understood that these examples are merely illustrative, are not limiting, and are provided to illustrate the versatility of options available in various embodiments of lid 20, and/or any component thereof.

In some embodiments, a variety of processes or combination thereof may be used to form lid 20, and/or any component thereof, or any layer or substrate used therein. For example, any component, layer, or substrate, or combination thereof, may be thermoformed, injection molded, injection stretch blow molded, blow molded, extrusion blow molded, coextruded, subjected to any other suitable process, or subjected to any combination thereof. In some embodiments, lid 20, and/or any component thereof may be formed substantially of injection molded and/or thermoformed suitable plastics material, although other materials and forming processes may be used instead of or in addition to injection molding and thermoforming, respectively. Various materials and/or processes may be used to form lid 20, and/or any component thereof, as will be understood by one of ordinary skill in the art. In some embodiments, lid 20, and/or any component thereof, may be substantially a one-piece design and/or substantially formed as an integral or unitary structure. Reference is hereby made to U.S. Publication No. 2020/0140160 and titled DRINK CUP LID for disclosure relating to drink cup lids that are made from a material comprising polypropylene, which application is hereby incorporated in its entirety herein. Reference is hereby made to U.S. Publication No. 2019/0039328 and titled METHOD AND APPARATUS FOR THERMOFORMING AN ARTICLE for disclosure relating to a method of manufacturing lids, which application is hereby incorporated in its entirety herein.

In some embodiments, while some directional terms are used herein, such as top, bottom, upper, lower, inward, outward, upward, downward, etc., these terms are not intended to be limiting but rather to relate to one or more exemplary orientations, positions, and/or configurations of lid 20, and/or any component thereof. It is understood lid 20 and/or any component or portion thereof may be inverted or re-oriented to face or point a different direction without departing from the nature of lid 20 disclosed herein.

The invention claimed is:

1. A drink cup lid comprising a ring-shaped brim mount adapted to mate with a brim of a drink cup, a central closure surrounded by the brim mount and formed to include an upstanding drink spout having a top wall formed to include a liquid-discharge outlet and a side wall arranged to extend downwardly from the top wall toward an interior region surrounded by the ring-shaped brim mount, and an outlet closure coupled to the top wall of the upstanding drink spout for movement about a horizontally extending pivot axis between a closed position closing the liquid-discharge outlet formed in the top wall of the upstanding drink spout and an opened position away from the liquid-discharge outlet, wherein the ring-shaped brim mount includes an inner side wall coupled to an outer edge of the central closure, a top wall coupled to an upper end of the inner side wall, and an outer side wall coupled to an outer edge of the top wall of the ring-shaped brim mount such that the outer side wall is spaced apart radially from the inner side wall, wherein the inner side wall is formed to include a series of indents spaced circumferentially apart from one another about a central axis of the drink cup lid, wherein each of the indents includes a curved sidewall and a bottom wall that extends perpendicular to the curved sidewall, wherein the central closure further includes a closure basin spaced apart from the top wall of the ring-shaped brim mount by a first distance, and wherein the bottom wall of each indent is spaced apart from the top wall of the ring-shaped brim mount by a second distance less than the first distance, and wherein the closure basin includes a lower top wall spaced apart from the top wall of the ring-shaped brim mount by the first distance and a plateau coupled to the lower top wall and having a plateau top wall that is spaced apart vertically from the top wall of the ring-shaped brim mount by a third distance that is less than the first distance and the second distance.

2. The drink cup lid of claim 1, wherein the series of indents are each formed at least partially into the top wall of the ring-shaped brim mount.

3. The drink cup lid of claim 2, wherein the top wall has a first radial width at each of the indents and the top wall has a second radial width, greater than the first radial width, circumferentially between each of the indents.

4. The drink cup lid of claim 3, wherein each of the indents is at least partially defined by the curved sidewall to provide the top wall with a third radial width, greater than the first radial width and less than the second radial width, at a location circumferentially between the first radial width and the second radial width.

5. The drink cup lid of claim 1, wherein the curved sidewall is concave relative to the central axis of the drink cup lid.

6. The drink cup lid of claim 5, wherein the curved sidewall of each indent has a center located radially between the inner side wall of the ring-shaped brim mount and the central axis of the drink cup lid.

7. The drink cup lid of claim 1, wherein the series of indents are arranged symmetrically about a first plane extending through the central axis and the outlet closure and the series of indents are arranged unsymmetrically about a second plane extending perpendicular to the first plane.

8. A drink cup lid comprising a brim mount adapted to mate with a brim of a drink cup, a central closure surrounded by the brim mount and formed to include a liquid-discharge outlet, and an outlet closure coupled to the central closure for movement about a horizontally extending pivot axis between a closed position closing the liquid-discharge outlet and an opened position away from the liquid-discharge outlet, wherein the brim mount includes an inner side wall coupled to an outer edge of the central closure, a top wall coupled to an upper end of the inner side wall, and an outer side wall coupled to an outer edge of the top wall such that the outer side wall is spaced apart radially from inner side wall, and wherein the inner side wall is formed to include a series of indents spaced circumferentially apart from one another about a central axis of the drink cup lid and configured to engage the brim of the drink cup when the drink cup lid is mounted on the drink cup, wherein each of the indents includes a curved sidewall and a bottom wall that extends perpendicular to the curved sidewall, wherein the central closure includes a closure basin spaced apart from the top wall of the brim mount by a first distance, and wherein the bottom wall of each indent is spaced apart from the top wall of the brim mount by a second distance less than the first distance, and wherein the closure basin includes a lower top wall spaced apart from the top wall of the brim mount by the first distance and a plateau coupled to the lower top wall and having a plateau top wall that is spaced apart vertically from the top wall of the brim mount by a third distance that is less than the first distance and the second distance.

9. The drink cup lid of claim 8, wherein the series of indents are each formed at least partially into the top wall of the brim mount.

10. The drink cup lid of claim 9, wherein the top wall has a first radial width at each of the indents and the top wall has a second radial width, greater than the first radial width, circumferentially between each of the indents.

11. The drink cup lid of claim 10, wherein the top wall has a third radial width, greater than the first radial width and less than the second radial width, at a location circumferentially between the first radial width and the second radial width.

12. The drink cup lid of claim 8, wherein the curved sidewall is concave relative to the central axis of the drink cup lid.

13. The drink cup lid of claim 12, wherein the curved sidewall of each indent has a center located radially between the inner side wall of the brim mount and the central axis of the drink cup lid.

14. The drink cup lid of claim 8, wherein the series of indents are arranged symmetrically about a first plane extending through the central axis and the outlet closure and the series of indents are arranged unsymmetrically about a second plane extending perpendicular to the first plane.

* * * * *